US007997701B2

(12) United States Patent
Yazawa

(10) Patent No.: US 7,997,701 B2
(45) Date of Patent: Aug. 16, 2011

(54) INKJET PRINTER AND INK TANK

(75) Inventor: Hiroaki Yazawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1127 days.

(21) Appl. No.: 11/692,652

(22) Filed: Mar. 28, 2007

(65) Prior Publication Data

US 2007/0242112 A1 Oct. 18, 2007

(30) Foreign Application Priority Data

Mar. 29, 2006 (JP) ..... 2006-090188

(51) Int. Cl.
*B41J 2/175* (2006.01)
*B41J 2/015* (2006.01)
*B41J 2/165* (2006.01)

(52) U.S. Cl. ..... 347/86; 347/21; 347/28

(58) Field of Classification Search ..... 347/21, 347/22, 85, 86, 28
See application file for complete search history.

(56) References Cited

U.S. PATENT DOCUMENTS

| | | | | |
|---|---|---|---|---|
| 6,027,196 | A * | 2/2000 | Gotoh et al. | 347/7 |
| 6,102,537 | A | 8/2000 | Kato et al. | |
| 6,267,476 | B1 | 7/2001 | Kato et al. | |
| 2004/0021107 | A1 | 2/2004 | Kimura et al. | |
| 2004/0036735 | A1 * | 2/2004 | Garbacz et al. | 347/22 |
| 2006/0001710 | A1 * | 1/2006 | Lee | 347/86 |

FOREIGN PATENT DOCUMENTS

| | | | |
|---|---|---|---|
| JP | 8216430 | A | 8/1996 |
| JP | 2003343756 | A | 12/2003 |
| JP | 2004009447 | A | 1/2004 |

* cited by examiner

*Primary Examiner* — Geoffrey Mruk
(74) *Attorney, Agent, or Firm* — Banner & Witcoff, Ltd

(57) ABSTRACT

The ink tank includes an ink chamber and a cleaning solvent chamber. Ink is stored in the ink chamber. Cleaning solvent is stored in the cleaning solvent chamber. Mounting portions are provided on the bottom surface side of the ink tank. One of the mounting portions is provided corresponding to the ink chamber, and the other mounting portion is provided corresponding to the cleaning solvent chamber. The ink tank is mounted to a scanning carriage by the mounting portions being fitted into a holding unit of the scanning carriage. Deriving ports may be formed on the bottom surfaces of recesses of the mounting portions.

24 Claims, 23 Drawing Sheets

INKJET PRINTER AND INK TANK

RELATED APPLICATION INFORMATION

This application claims priority to Japanese Application No. 2006-090188, filed Mar. 29, 2006, whose contents are expressly incorporated herein by reference.

BACKGROUND

1. Field of the Invention

Aspects of the present invention relate to a printer of an inkjet system for performing image recording by discharging ink drops on a recording medium and, more specifically, to a system for supplying ink from an ink tank.

2. Description of the Related Art

In the related art, a color printer is known in which a color image is recorded onto on a printing medium using inks of different color hues such as cyan (C), magenta (M), yellow (Y), and black (Bk). Although various printing systems are employed in color printing, so called "inkjet systems" are in general use (in which images are recoded on a printing medium by pressurizing and injecting ink through the use of partial deformation of a nozzle hole on a recording head or local ink boiling). In a color printer employing the inkjet system, the various colors of ink are supplied from ink tanks in which the respective colors of ink are supplied to a recording head, and the recording head selectively discharges the ink in the respective colors from nozzles according to a predetermined system, so that minute dots are formed on the recording medium. Accordingly, a desired color image is formed on the recording medium.

In the color printer of this type, positions for mounting the ink tanks for the respective colors are generally fixed in advance. On the other hand, one known system describes an inkjet recording apparatus in which an ink tank of another color, such as an ink tank for black (Bk) (black ink tank), may be mounted to positions where ink tanks for cyan (C), magenta (M), and yellow (Y) are mounted, so that recording control according to the ink color in the ink tank is performed. This inkjet recording apparatus functions as a color printer when the ink tanks for the respective colors (color ink tanks) are mounted. When all the color ink tanks are replaced with the black ink tanks, the recording apparatus functions as a monochrome specific printer. In this case, black ink is discharged from all the nozzles on the recording head so that high-speed monochrome printing is enabled. When the black ink tanks are replaced with the original color ink tanks, the recording apparatus may be used as the color printer.

In the printer of an inkjet system, when the ink tank is replaced with a new ink tank, a purging process is performed for sucking and removing residual ink from the recording head as well as air bubbles from the nozzles of the recording head. The purging process is of course performed in the case in which the ink tanks are replaced in the inkjet recording apparatus. However, in these inkjet printing systems, when an ink tank of a different color is mounted in the position previously occupied by an ink tank of another color, residual ink in an ink needle or a push rod is interfused into the ink tank and is dispersed therein. Hence, the ink of the old color is disadvantageously mixed with the new ink of the new color after replacement. Assuming that the residual ink is not dispersed in the entire area in the ink tank, part of the ink mixed in the ink tank cannot be sucked and removed sufficiently with the normal purging process even when the purging process is carried out after the replacement of the ink tank. On the other hand, although it is assumed that the mixed ink is sucked and removed when the purging process is carried out for a long time, a large amount of ink is undesirably used in the purging process and hence wasted.

When an ink tank of a different color (from the color of another color previously located at a given position) is mounted to the given position, the ink after replacement is mixed with the residual ink remaining in a flow path in the recording head and hence a mixed color is generated. In this case, it is necessary to remove the mixed color ink by the purging process. However, the time required for removing the mixed color ink by the purging process differs depending on the difference between the ink color used before the replacement of the ink tank and the ink color used after the replacement. For example, when the ink is changed from a light color (yellow, for example) to a dark color (black), since the light color of the ink is absorbed by the ink in the dark color, a purging process lasting only a short time will be sufficient for removing the mixed color ink. In contrast, when the ink is changed from the dark color (black) to the light color (yellow), the light color ink may be changed in color by the ink in the dark color by mixing, so that the system is required to suck and remove a large amount of the former ink. Hence the purging process needs to be carried out for a long time. If the same purging process is carried out under such a circumstance as well, not only an excess of ink is disposed, but also it takes a long time to achieve a printable state.

SUMMARY

One or more aspects of the invention relate to providing a system that can provide fresh ink without significant waste of ink. Other aspects of the invention are described below.

DETAILED DESCRIPTION

Figure 1:
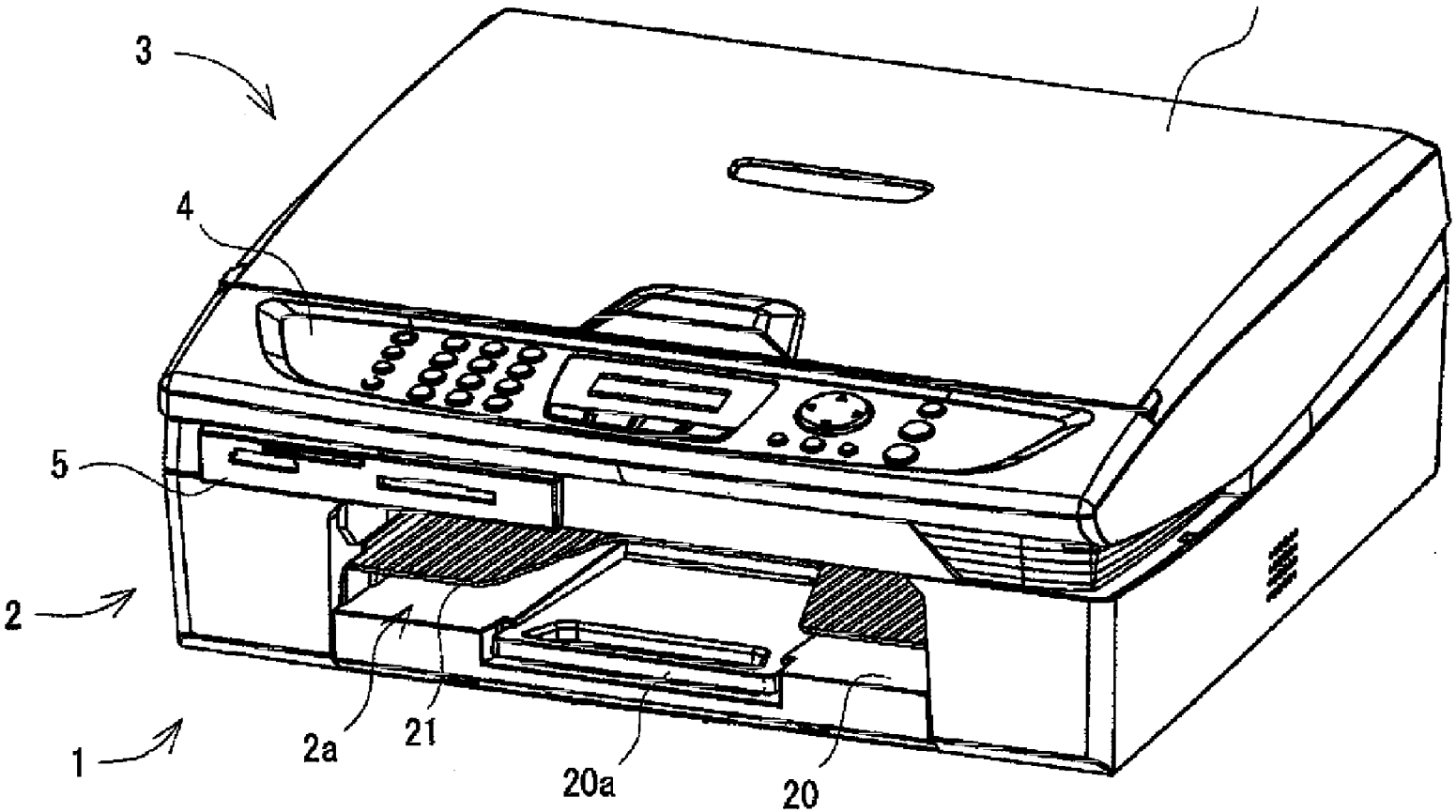
FIG. 1 is a perspective view showing an appearance configuration of a multi-function machine 1 according to one or more embodiments of the invention.

Aspects of the invention relate to providing reliable purging of a printing system.

It is noted that various connections are set forth between elements in the following description. It is noted that these connections in general and, unless specified otherwise, may be direct or indirect and that this specification is not intended to be limiting in this respect.

Aspects of the invention may be applied to printing systems that use ink including but not limited to 1) printing systems that have ink tanks integrated with print heads, 2) printing systems that have ink tanks mountable in a holder, where the holder includes the print heads, and 3) printing systems that have ink tanks that intermittently refill ink holding tanks, where the ink holding tanks convey ink to print heads. For purposes of explanation, one or more aspects of the invention are described by way of example with relation to the second type of printing systems described above. However, it is appreciated that various aspects of the invention may be used in printing systems of the first type and third type as described above as well.

First Embodiment

Referring now to the drawings, a first embodiment will be described. The embodiment is illustrative only, and it is apparent that the embodiment may be modified as needed without departing from the scope of the invention.

Figure 2:
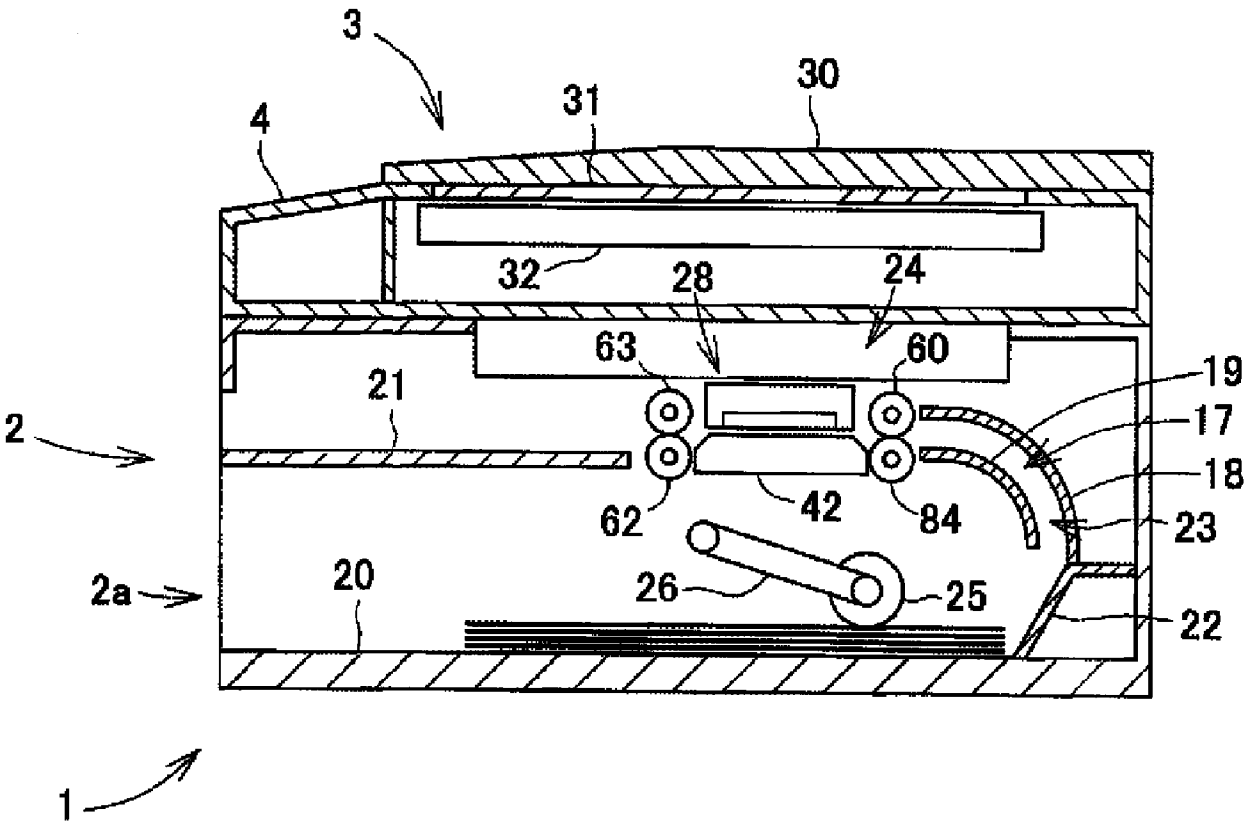
FIG. 2 is a vertical cross-sectional view showing an internal configuration of the multi-function machine 1 in accordance with aspects of the invention.

FIG. 1 shows a configuration of a multi-function machine 1 according to one embodiment. FIG. 2 is a vertical cross-sectional view showing an internal configuration of the multi-function machine 1. The multi-function machine 1 is a multi function device (MFD) integrally including a printer unit 2 in a lower part and a scanner unit 3 in an upper part, and has a printing function, a scanning function, a copying function, and a facsimile function. The printer unit 2 in the multi-function machine 1 corresponds to a printer as described herein. Therefore, functions other than the printing function are arbitrary. Hence, aspects of the invention may also be applied to a single function printer which does not have the scanner unit 3 and hence does not have the scanning function and the copying function.

The printer unit 2 of the multi-function machine 1 is mainly connected to external information equipment such as a computer, and records images or documents on recording sheets on the basis of print data including image data and document data transmitted from the computer. The multi-function machine 1 is also capable of being connected with a digital camera to record image data outputted from the digital camera on the recording sheet, or being mounted with various types of recording media, such as a memory card, and recording the image data stored in the recording medium on the recording sheet.

As shown in FIG. 1, the multi-function machine 1 has a substantially wide and thin parallelepiped outline whose width and depth are larger than the height, and the lower part of the multi-function machine 1 is the printer unit 2. The printer unit 2 has an opening 2*a* in the front thereof. A paper feed tray 20 and a paper discharge tray 21 are provided inside the opening 2*a* in two levels of an upper level and a lower level. The paper feed tray 20 accommodates recording sheets as recording media, and accommodates recording sheets of various sizes, such as B5 size and post-card size, which are smaller than A4 size.

The upper part of the multi-function machine 1 is the scanner unit 3, and is configured as so-called a flat-bed scanner. As shown in FIG. 1 and FIG. 2, a platen glass 31 and an image sensor 32 are provided underside a document cover 30 provided as a top plate of the multi-function machine 1 so as to be opened and closed. An original document for image reading is placed on the platen glass 31. Provided below the platen glass 31 is the image sensor 32 having a primary scanning direction in the direction of the depth (in the left and right direction in FIG. 2) of the multi-function machine 1 so as to be capable of reciprocating in the direction of the width of the multi-function machine 1 (in the direction vertical to the paper plane of FIG. 2).

Provided on the upper part of the front surface of the multi-function machine 1 is an operation panel 4 for operating the printer unit 2 or the scanner unit 3. The operation panel 4 includes various operating buttons and a liquid crystal display. The multi-function machine 1 may be operated on the basis of operation instructions from the operation panel 4. When the multi-function machine 1 is connected to the external computer, the multi-function machine 1 may also be operated upon reception of instructions transmitted from the computer via a printer driver or a scanner driver. A slot unit 5 is provided at an upper left portion on the front surface of the multi-function machine 1. Various compact memory cards as recording media may be inserted into the slot unit 5. By performing a predetermined operation by the operation panel 4, image data stored in the compact memory card inserted into the slot unit 5 is read. Information on the read image data is displayed on the liquid crystal display on the operation panel 4, and on the basis of this display, an arbitrary image is recorded on the recording sheet by the printer unit 2.

Referring now to FIG. 2 to FIG. 10, the internal configuration of the multi-function machine 1, in particular, a configuration of the printer unit 2 will be described. As shown in FIG. 2, the paper feed tray 20 is provided on the bottom side of the multi-function machine 1, and a separation inclined panel 22 is provided at the back of the paper feed tray 20. The separation inclined panel 22 separates the recording sheets fed together from the paper feed tray 20 and guides an uppermost recording sheet upward. A paper feed path 23 extends upward from the separation inclined panel 22 and then curved toward the front, extends from the back side to the front side of the multi-function machine 1 and communicates with the paper discharge tray 21 via an image recording unit 24. Therefore, the recording sheet accommodated in the paper feed tray 20 is guided from the bottom upward so as to make a U-turn along the paper feed path 23 and reached the image recording unit 24 is subject to the image recording by the image recording unit 24, and is discharged into the paper discharge tray 21.

Figure 3:
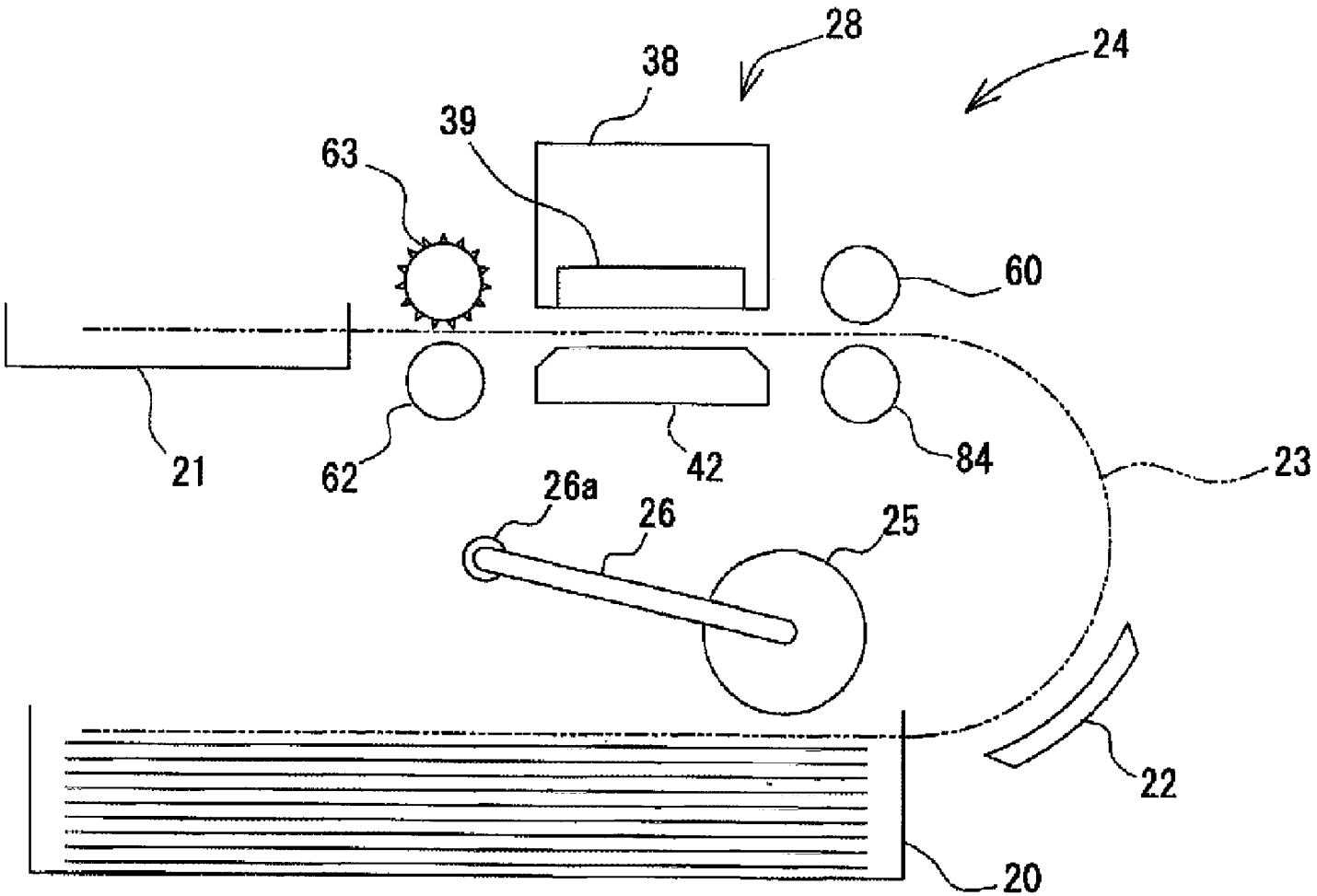
FIG. 3 is an enlarged pattern diagram showing a principal configuration of a printer unit 2 in accordance with aspects of the invention.

FIG. 3 is a partly enlarged pattern diagram showing a principal configuration of the printer unit 2. As shown in FIG. 3, a paper feed roller 25 for supplying recording sheets accommodated in the paper feed tray 20 to the paper feed path 23 is provided above the paper feed tray 20. The paper feed roller 25 is supported at the distal ends of paper feed arms 26 via a shaft. The paper feed roller 25 rotates by being driven by an LF motor 71 (see FIG. 4, FIG. 8) by a drive transmission mechanism, not shown, including a plurality of gears meshed with each other.

The paper feed arms 26 includes a base shaft 26*a* as an axis of rotation and moves vertically so as to move into and out of contact with the paper feed tray 20. The paper feed arms 26 are urged by their weight or a spring or the like and are rotated downward so as to move into contact with the paper feed tray 20, and are capable of being retracted upward when the paper feed tray 20 is inserted or drawn out. When the paper feed arms 26 are rotated downward, the paper feed roller 25 supported at the distal ends thereof via the shaft moves into press-contact with the recording sheet on the paper feed tray 20. In this state, when the paper feed roller 25 is rotated, the uppermost recording sheet is fed to the separation inclined panel 22 by a frictional force between a roller surface of the paper feed roller 25 and the recording sheet. The recording sheet abuts at a leading edge with the separation inclined panel 22 and is guided upward, and is fed to the paper feed path 23. When the uppermost recording sheet is fed by the paper feed roller 25, there is a case in which a recording sheet immediately under the corresponding recording sheet is also fed by a frictional force or static electricity. However, the recording sheet is constrained by abutment with the separation inclined panel 22.

The paper feed path 23 is defined by an outer guide plane and an inner guide plane opposed to each other at a predetermined distance other than the position where the image recording unit 24 is provided. For example, a curved portion 17 (see FIG. 2) of the paper feed path 23 on the back side of the multi-function machine 1 includes an outer guide member 18 and an inner guide member 19 being fixed to an apparatus frame. Provided particularly at the curved portion of the paper feed path 23 are rotating rollers, not shown, which expose roller surfaces toward the outer guide plane and rotate freely about the widthwise direction of the paper feed path 23 as the axes of rotation. The recording sheet, which slides on the guide planes at the curved portion of the paper feed path 23, is fed smoothly by the freely rotatable rotating rollers.

Figure 4:
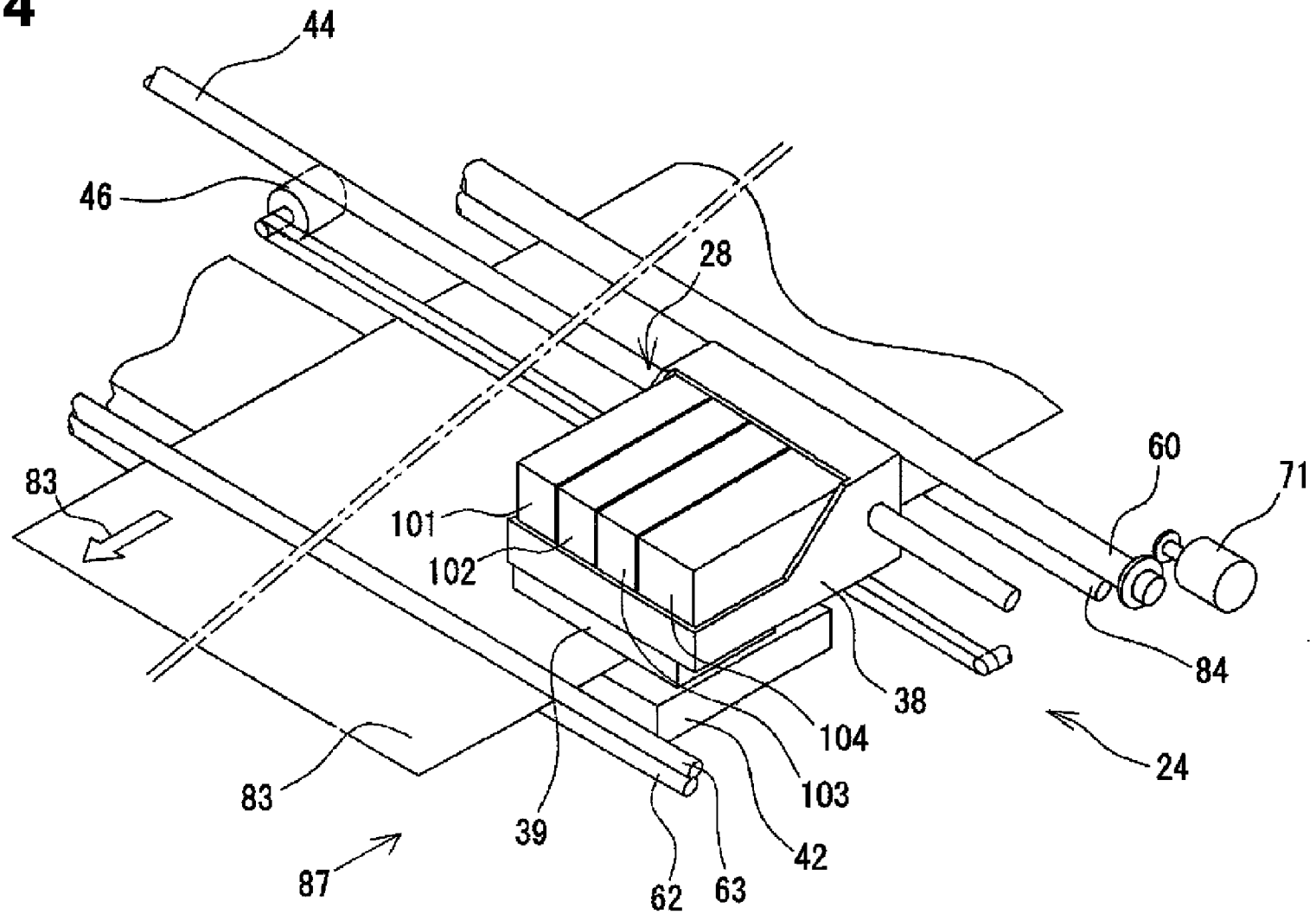
FIG. 4 is a perspective sketch showing a configuration of an image recording unit 24 in accordance with aspects of the invention.

FIG. 4 is a perspective sketch showing a configuration the image recording unit 24. As shown in FIGS. 3 and 4, the paper feed path 23 is provided with the image recording unit 24. As shown in the same drawings, there is provided a platen 42 arranged underside of the image recording unit 24 so as to oppose the image recording unit 24. The platen 42 is disposed over a center portion where the recording sheet passes in a range where a head unit 28, described later, reciprocates. The width of the platen 42 can be sufficiently larger than the maximum width of the recording sheet which can be fed, that is, the maximum width of the recording sheet in the direction orthogonal to the feeding direction, so that the both ends of the recording sheet always pass over the platen 42.

The image recording unit 24 is provided with the head unit 28 and ink tanks 101 to 104 of a cartridge type for supplying ink to an inkjet recording head (hereinafter, referred to as "recording head") 39, described later, as shown in FIG. 4. One or more aspects of the invention may be characterized by the ink tanks 101 to 104. The ink tanks 101 to 104 do not necessarily have to be the cartridge type, and any types will be acceptable as long as they can store ink therein.

In this embodiment, four ink tanks for storing four colors of ink, cyan (C), magenta (M), yellow (Y), and black (Bk) are provided in the head unit 28, so that the four colors of ink are supplied from the respective ink tanks 101 to 104 to the recording head 39. It is apparent that the colors of the ink to be stored therein, and the number of the ink tanks may be modified as needed according to the recording resolution of the image recording unit 24.

As shown in FIGS. 3 and 4, the image recording unit 24 is configured to perform image recording on the recording sheet 83 fed over the platen 42. That is, an image is recorded on the recording sheet 83, which is fed in the direction indicated by an arrow 86 in FIG. 4, intermittently by a sliding movement of the head unit 28 in the primary scanning direction while discharging the ink in the respective colors of cyan (C), magenta (M), yellow (Y), and black (Bk) is supplied from the ink tanks 101 to 104.

The head unit 28 is provided with a scanning carriage 38. The scanning carriage 38 is provided with a holding unit 40 (see FIG. 12) for holding the ink tanks 101 to 104. The ink tanks 101 to 104 are demountably held by the holding unit 40. One or more aspects of the invention may be characterized by a holding structure of the ink tanks 101 to 104 by the holding unit 40. The holding unit 40 will be described later in detail. The scanning carriage 38 having the holding unit 40 corresponds to a refill unit as described herein.

The head unit 28 includes the recording head 39. The recording head 39 can also be held by the scanning carriage 38. The recording head 39 is provided so as to be exposed from the lower surface of the scanning carriage 38. The ink tanks 101 to 104 are arranged above the recording head 39. The ink is supplied from the ink tanks 101 to 104 to the recording head 39. The scanning carriage 38 is supported by a guide shaft 44, and is capable of sliding along the guide shaft 44. In this embodiment, a supporting configuration in which the guide shaft 44 is inserted into a through hole 137 (see FIG. 12) provided on the back side of the scanning carriage 38 is employed as supporting device of the scanning carriage 38 by the guide shaft 44. Needless to say, the supporting device is not limited to the supporting structure described above, and various supporting structures such as a structure for slidably supporting using the rail or the like may also be employed.

An endless belt (not shown) is mounted to the scanning carriage 38. A belt drive motor 46 is connected to the endless belt via a pulley. The head unit 28 slides in the primary scanning direction by the operation of the belt drive motor 46.

While the head unit 28 slides in this manner, ink in the respective colors is selectively discharged from the recording head 39 as minute ink drops, so that an image is recorded on the recording sheet fed over the platen 42.

Figure 5:
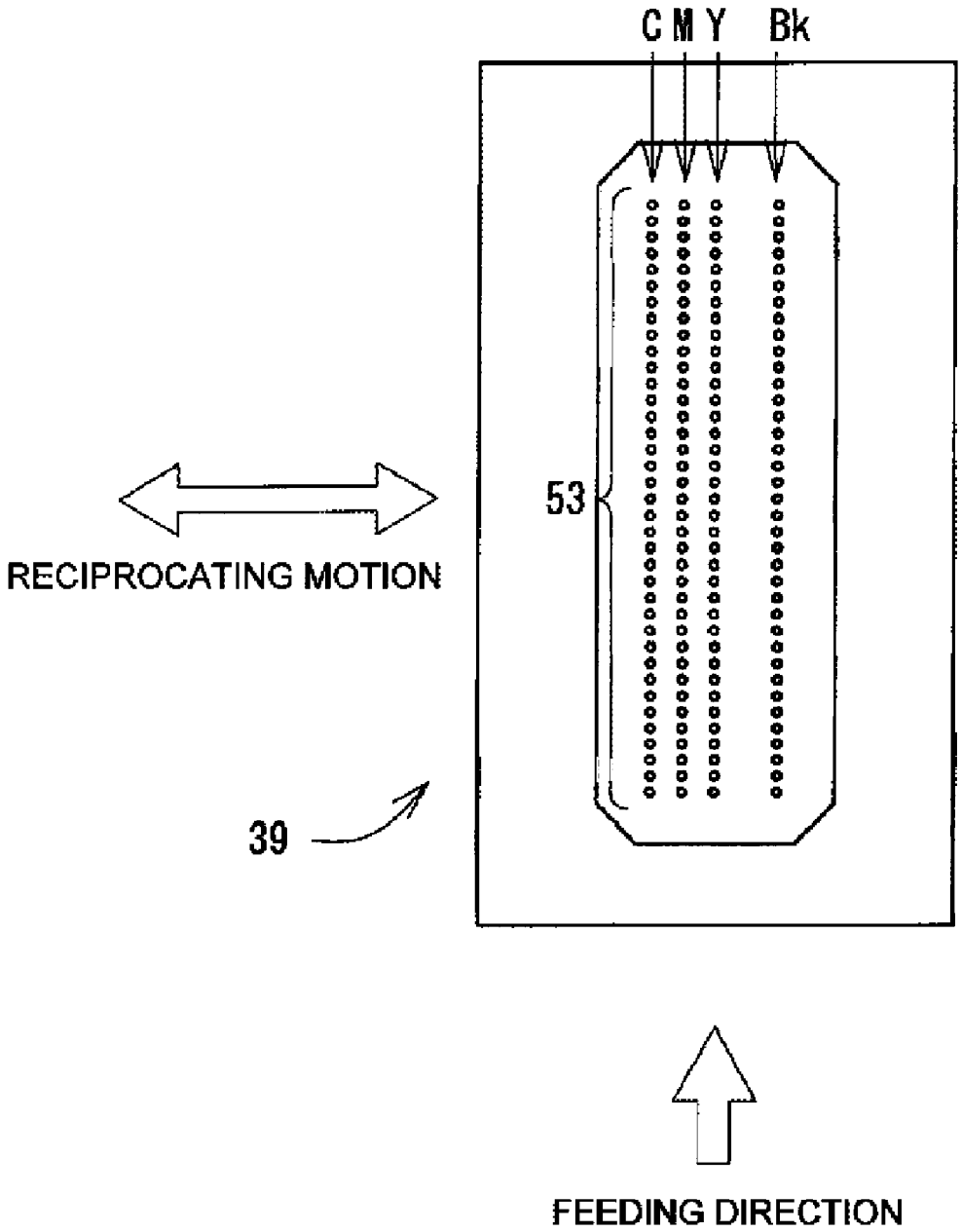
FIG. 5 is a bottom view showing a nozzle formed surface of an inkjet recording head 39 in accordance with aspects of the invention.

FIG. 5 is a bottom view showing a nozzle formed surface of the recording head 39. The structure of the bottom surface of the recording head 39 is shown in detail. As shown in the drawing, the recording head 39 includes a plurality of nozzles 53 formed of minute holes arranged in rows for the ink in the respective colors, cyan (C), magenta (M), yellow (Y), and black (Bk), in the recording sheet feeding direction. In the drawing, the vertical direction corresponds to the recording sheet feeding direction, and the right and left direction corresponds to the direction of reciprocation of the scanning carriage 38. The nozzles 53 for the ink in the respective colors of CMYBk are arranged in rows respectively in the recording sheet feeding direction. The rows of the nozzles 53 for the ink in the respective colors are arranged in the direction of reciprocation of the scanning carriage 38.

In FIG. 5, the rightmost nozzles 53 correspond to black ink (Bk), and the black ink (Bk) is discharged from these nozzles 53. Adjacent to the nozzles 53 for the black ink (Bk), three rows of nozzles 53 are provided in sequence. The nozzles 53 in the respective rows correspond to yellow ink (Y), magenta ink (M), and cyan ink (C), and yellow ink (Y), magenta ink (M), and cyan ink (C) are discharged from the respective nozzles 53. That is, the recording head 39 can discharge the four colors of ink. The pitch or the number of the nozzles 53 in the feeding direction are set as needed considering the resolution or the like of the recorded image. The number of rows of the nozzles 53 may be increased or decreased according to the number of colors of the color ink.

Figure 6:
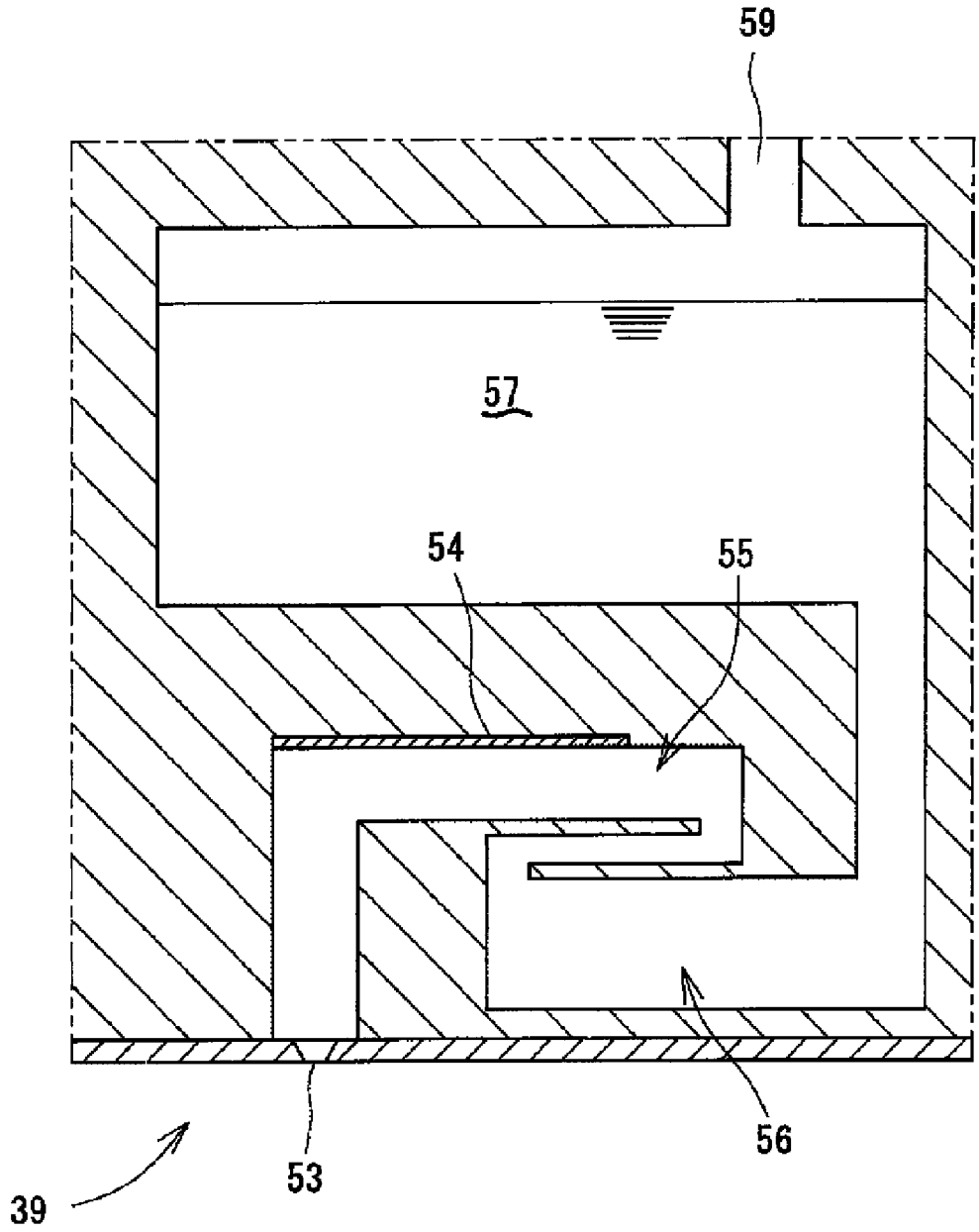
FIG. 6 is a pattern diagram schematically showing a cross-sectional configuration of the inkjet recording head 39 in accordance with aspects of the invention.

FIG. 6 is a partly enlarged schematic cross-sectional view showing an internal configuration of the recording head 39. As shown in the same drawing, a cavity 55 having a piezoelectric element 54 is formed on the upstream side of the nozzles 53 formed on the lower surface of the recording head 39. The piezoelectric element 54 is configured in such a manner that the shape of the element is deformed by a predetermined voltage applied thereto, thereby being varied in mass. The capacity of the cavity 55 is increased or decreased by the deformation of the shape of the piezoelectric element 54. The ink in the cavity 55 is compressed by reduction of the capacity of the cavity 55 and is discharged from the nozzles 53 as ink drops.

The cavity 55 is provided one for the nozzles 53 corresponding to each of the colors of CMYBk. Manifolds 56 are formed over the plurality of cavities 55 corresponding to the ink in the respective colors of CMYBk. The manifolds 56 are provided for the ink in the respective colors of CMYBk. Disposed on the upstream side of the manifolds 56 are buffer tanks 57. The buffer tanks 57 are also provided for the ink in the respective colors of CMYBk. The buffer tanks 57 each include a supply port 59 for introducing the ink supplied from the ink tanks 101 to 104 to the recording head 39. The supply port 59 is connected to a push rod 134 (which corresponds to an introduction device as described herein) formed on the scanning carriage 38, described later. The inks in the respective colors CMYBk are supplied to the recording head 39 from the ink tanks 101 to 104 through the supply ports 59. The supplied ink is stored once in the buffer tanks 57. Accordingly, the cavities 55 and the manifolds 56 are protected from air bubbles entering therein. The air bubbles caught in the buffer tanks 57 are removed from air bubble discharge ports, not shown. The ink supplied from the buffer tanks 57 to the manifolds 56 are distributed to the respective cavities 55 through the manifolds 56.

Figure 7:
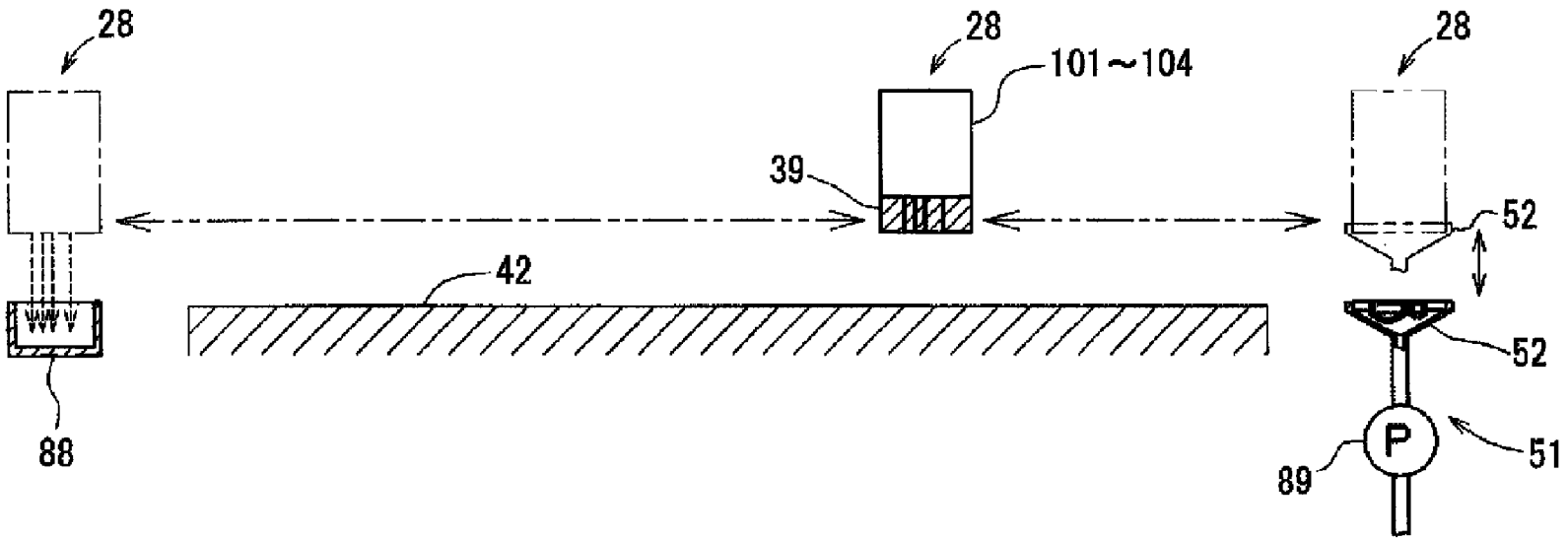
FIG. 7 is a sketch showing an operating position of a head unit 28 and a position where a maintenance unit is disposed in accordance with aspects of the invention.

FIG. 7 is a sketch showing an operating position of the head unit 28 and the position where a maintenance unit is disposed, and is a drawing of the head unit 28 and the maintenance unit (a purging mechanism 51 and a waste ink tray 88) viewed from the direction indicated by an arrow 87 in FIG. 4. As shown in the same drawing, the purging mechanism 51 and the waste ink tray 88 are located in the range where the recording sheet does not pass. More specifically, the purging mechanism 51 is disposed on one end (right end in FIG. 7) in the direction of the width of the platen 42. The waste ink tray 88 is disposed at the other end in the direction of the width of the platen 42 (left end in FIG. 7).

The purging mechanism 51 is configured to suck and remove the air bubbles or the mixed color ink from the nozzles 53 (see FIG. 5) of the recording head 39 and is an example of a removing device as described herein. The purging mechanism 51 includes a cap 52 for covering the nozzles 53 of the inkjet recording head 39, a pump 89 connected to the recording head 39 via the cap 52, and a moving mechanism for moving the cap 52 toward and away from the nozzles 53 of the recording head 39. In FIG. 7, the moving mechanism is not shown.

A purging operation by the purging mechanism 51, that is, a sucking and removing operation is carried out as shown below. The head unit 28 is moved so that the recording head 39 is positioned substantially immediately above the cap 52. In this state, the cap 52 is moved upward by the moving mechanism and is brought into tight contact with the lower surface of the recording head 39 so as to tightly close the nozzles 53. Then, the pump 89 is driven and starts sucking. When the interior of the cap 52 is brought into a negative pressured by the pump 89, ink is sucked from the nozzles 53 of the recording head 39. The sucked ink is sent to a predetermined waste ink tank. With such purging operation, air bubbles or foreign substances in the recording head 39 are removed with the ink. When the ink tank is replaced with another ink tank for ink of a different color from the color before replacement, mixed color ink which is generated by being mixed in the recording head is removed. The sucking and removing operation by the purging mechanism 51 is carried out by a controller 64 (see FIG. 8), described later, which controls the driving of the pump 89.

The waste ink tray 88 is configured to receive idle discharge of the ink from the recording head 39, which is called "flushing". The waste ink tray 88 is provided on the upper surface of the platen 42 within a range of the reciprocating motion of the head unit 28 and out of the image recording range. Felt is provided in the waste ink tray 88 so that flushed ink is absorbed and held by the felt. With the maintenance unit including the purge mechanism 51 and the waste ink tray 88, maintenance such as removal of the air bubbles or the mixed color ink in the recording head 39 or prevention of dryout is performed.

As shown in FIGS. 3 and 4, a feed roller 60 and a pinch roller 84 are provided on the upstream side of the image recording unit 24. In FIG. 3, the pinch roller 84 is arranged under the feed roller 60 in a press-contact manner. The feed roller 60 and the pinch roller 84 nip the recording sheet fed in the paper feed path 23 and carry the recording sheet onto the platen 42. A discharge roller 62 and a spur roller 63 are provided on the downstream side of the image recording unit 24. The discharge roller 62 and the spur roller 63 nip the recorded recording sheet and carry the recording sheet to the paper discharge tray 21. A drive force of the LF motor 71 (see FIG. 4) is transmitted to the feed roller 60 and the discharge roller 62 via a drive transmitting mechanism, not shown and are driven intermittently by a predetermined line feed width.

The rotations of the feed roller 60 and the discharge roller 62 are synchronized. A rotary encoder 76 (see FIG. 8) provided on the feed roller 60 senses by an optical sensor the pattern of an encoder disc, not shown, rotating together with the feed roller 60. The rotations of the feed roller 60 and the discharge roller 62 are controlled on the basis of the detected signal.

Since the spur roller 63 comes into press-contact with the recorded recording sheet, the spur roller 63 has a rough roller plane (like a spur) so as to prevent the image recorded on the recording sheet from being deteriorated. The spur roller 63 is provided so as to be capable of sliding in the direction toward and away from the discharge roller 62 and is urged by a coil spring to move into press-contact with the discharge roller 62. When the recording sheet enters between the discharge roller 62 and the spur roller 63, the spur roller 63 is retracted against the urging force by the thickness of the recording sheet and nips the recording sheet so as to come into press-contact with the discharge roller 62. Accordingly, the rotational force of the discharge roller 62 is positively transmitted to the recording sheet. The pinch roller 84 is also provided in the same manner with respect to the feed roller 60 and nips the recording sheet so as to come into press-contact with the feed roller 60, so that the rotational force of the feed roller 60 positively to the recording sheet.

Figure 8:
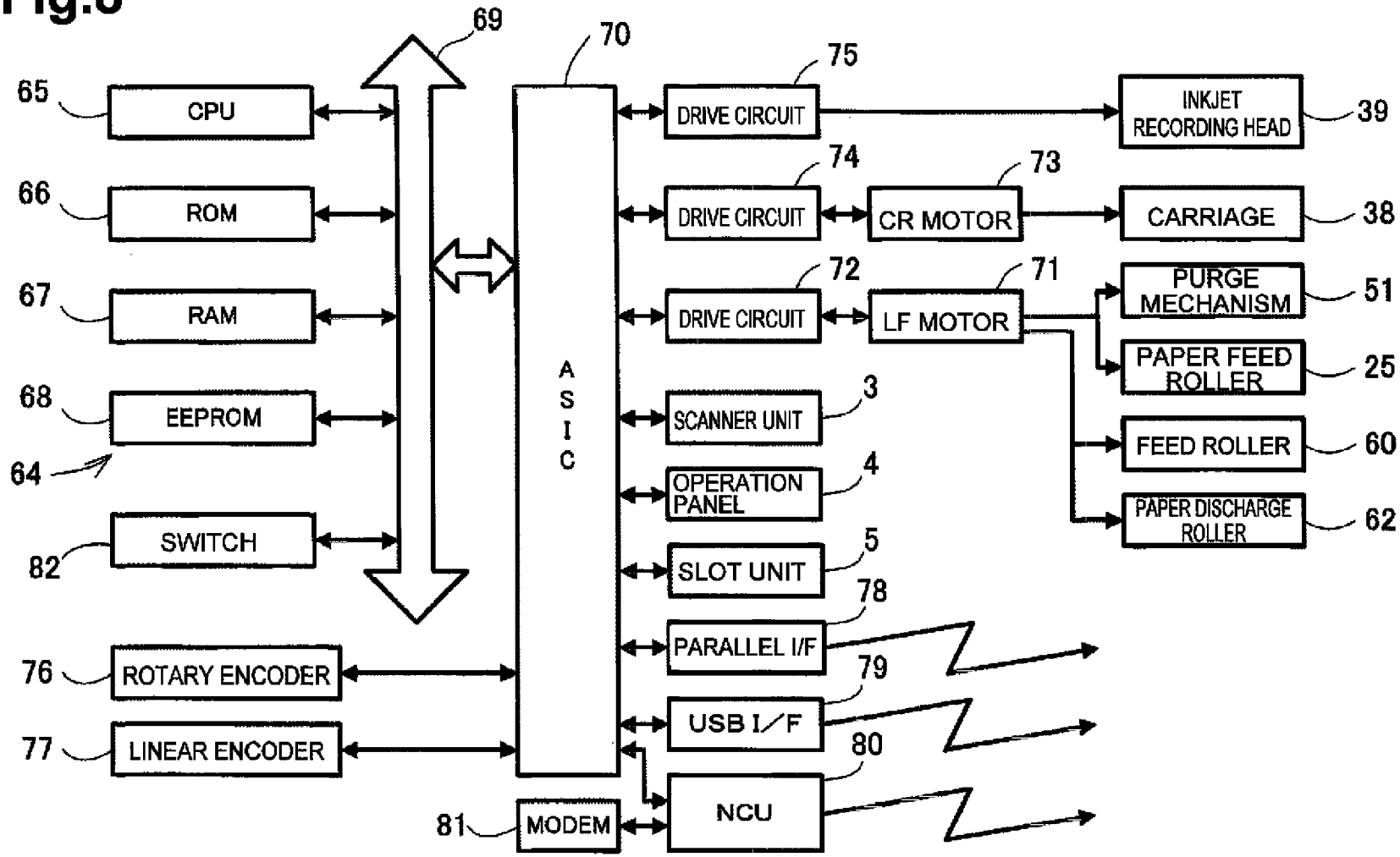
FIG. 8 is a block diagram showing a configuration of a controller 64 in the multi-function machine 1 in accordance with aspects of the invention.

FIG. 8 is a block diagram showing a configuration of the controller 64 of the multi-function machine 1. The controller 64 controls not only the printer unit 3, but also the entire operation of the multi-function machine 1 including the scanner unit 2. The controller 69 is provided with predetermined electronic parts mounted on a printed board. Since the configuration of the scanner unit 2 is not a principal configuration as described herein, detailed description will not be made. The controller 64 is configured as a microcomputer mainly including a CPU (Central Processing Unit) 65, a ROM (Read Only Memory) 66, a RAM (Random Access Memory) 67, and EEPROM (Electrically Erasable and Programmable ROM) 68 and is connected to an ASIC (Application Specific Integrated Circuit) 70 via a bus 69.

Various data such as a program for controlling the various operations of the multi-function machine 1, or an ink color correspondence list, described later, (see S25 in FIG. 22) are stored in the ROM 66. The ROM 66 is an example of a correspondence information recording device as described herein. The RAM 67 is used as a storage area or the operating area for temporarily storing various data used when the CPU 65 executes the above-described program. The EEPROM 68 is for storing settings or flags to be stored after having turned off the power as well.

The bus 69 is connected to a small switch 82 (an example of a position detecting device as described herein). The switch 82 is used for identifying the type of the ink tanks 101 to 104 mounted to the holding unit 40 (see FIG. 12) of the scanning carriage 38, described later. The switch 82 is provided on the scanning carriage 38, and the lead wire of the switch 82 is connected to the bus 69 via a predetermined connection port. Actually, four switches 82 are provided for respective mounting compartments 131 and hence sixteen switches 82 in total are provided on the scanning carriage 38, which are shown in FIG. 8 in a simplified manner. Connection ports to which the switches 82 are connected are monitored by the CPU 65. The CPU 65 identifies the type of the mounted ink tank on the basis of switch signals supplied to the connection ports. In this embodiment, the ink color corresponding to the ink tank is determined by identifying the type of the ink tank. Detailed description relating a method of determining the switches 82 and the ink colors will be given later with a modification of the invention.

An ASIC 70 controls the rotation of the LF motor 71 by generating inter-exciting signals to be distributed to the LF (carrier) motor 71, feeding the signals to a drive circuit 72 of the LF motor 71, and distributing the drive signals to the LF motor 71 via the drive circuit 72 according to the instruction from the CPU 65.

The drive circuit 72 is configured to drive the LF motor 71, which is connected to the paper feed roller 25, the feed roller 60, and the discharge roller 62. The LF motor 71 is connected to the purge mechanism 51. The drive circuit 72 generates the electric signals for rotating the LF motor 71 upon reception of the output signals from the ASIC 70. The LF motor 71 rotates upon reception of the electric signals. The rotational force of the LF motor 71 is transmitted to the paper feed roller 25, the feed roller 60, the discharge roller 62, and the purging mechanism 51 via the known drive mechanism composed mainly of gears and drive shaft.

The ASIC 70 controls the rotation of a CR (carriage) motor 73 by generating inter-exciting signals to be distributed to the CR (carriage) motor 73, feeding the signals to a drive circuit 74 of the CR motor 73, and distributing the drive signals to the CR motor 73 via the drive circuit 74 according to the instruction from the CPU 65.

The drive circuit 74 is configured to drive the CR motor 73 and generates electric signals for rotating the CR motor 73 upon reception of the output signals from the ASIC 70. The CR motor 73 rotates upon reception of the electric signals. The rotational force of the CR motor 73 is transmitted to the scanning carriage 38 via the belt drive motor 46, so that the scanning carriage 38 is reciprocated. The controller 64 controls the reciprocating motion of the carriage 38 in this manner.

A drive circuit 75 is configured to selectively discharge the ink in the respective colors from the inkjet recording head 39 onto the recording sheet at predetermined timings, and drives the inkjet recording head 39 upon reception of the output signals generated in the ASIC 70 on the basis of a drive control sequence outputted from the CPU 65. The drive circuit 75 is mounted to a head control substrate. Signals are transmitted from a main substrate, which constitutes the controller 64, to the head control substrate via a flat cable (not shown).

A rotary encoder 76 for detecting the amount of rotation of the feed roller 60 and a linear encoder 77 for sensing the position of the scanning carriage 38 are connected to the ASIC 70. The scanning carriage 38 is moved to the ends of guide shaft 44 on one side when the power of the multi-function machine 1 is turned on, and the sensed position by the linear encoder 77 is initialized. When the scanning carriage 38 is moved on the guide shaft 44 from the initial position, an optical sensor (not shown) provided on the scanning carriage 38 senses a pattern of an encoder strip (not shown), and the number of pulse signals on the basis of the pattern is read by the controller 64 as the amount of movement of the scanning carriage 38. The controller 64 controls the rotation of the CR motor 73 for controlling the reciprocating motion of the scanning carriage 38 on the basis of the amount of movement.

The scanner unit 3, the operation panel 4 for giving instructions for the operation of the multi-function machine 1, the slot unit 5 for inserting the various compact memory cards, a parallel interface 78, and a USB interface 79 (for transmitting data with the external information equipment such as a personal computer via a parallel cable or a USB cable) are connected to the ASIC 70. An NCU (Network Control Unit) 80 and a modem (MODEM) 81 for realizing the facsimile function are connected as well.

Referring now to FIGS. 9 to 16B, the ink tank 101 and the scanning carriage 38 will be described in detail. Since the ink tanks 102, 103 have the same shape as the ink tank 101, and the ink tank 104 has also the same shape as the ink tank 101 except, optionally, that the width may be larger, description will not be given here.

Figure 9:
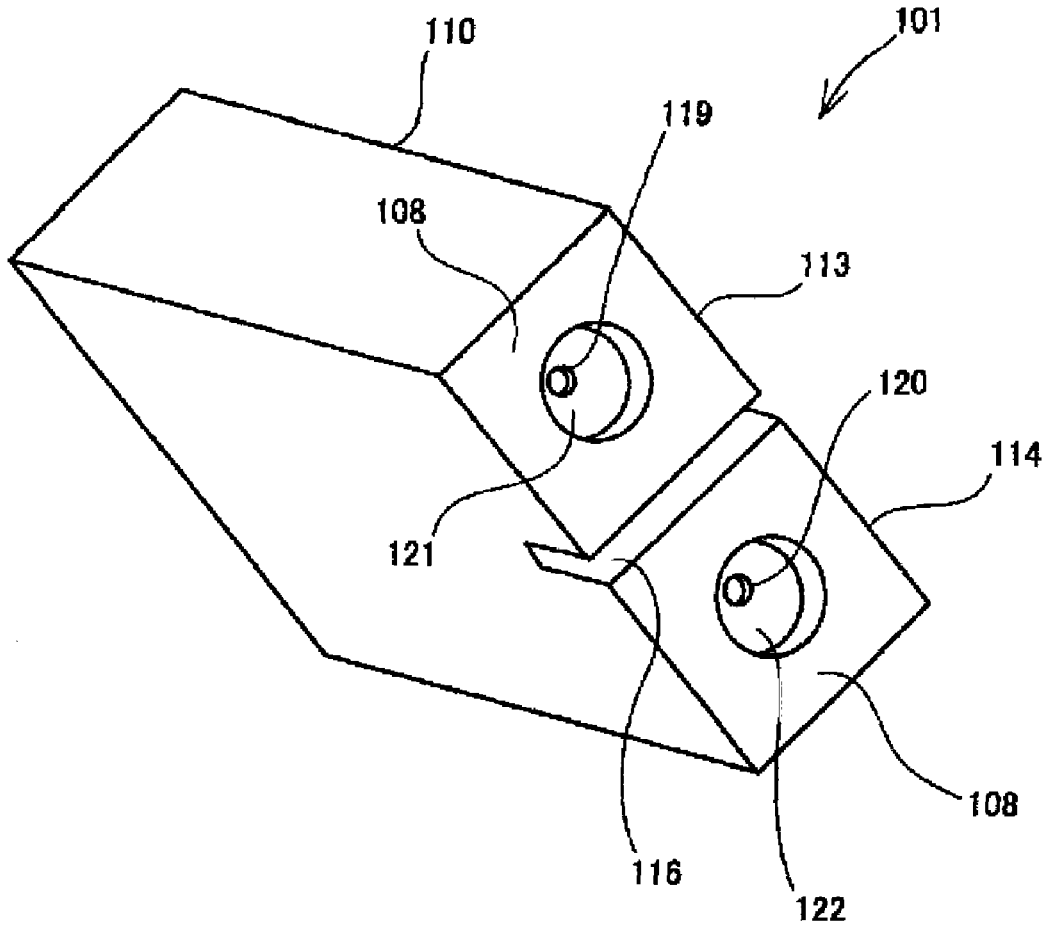
FIG. 9 show is a perspective view showing an appearance configuration of an ink tank 101 in accordance with aspects of the invention.
Figure 10:
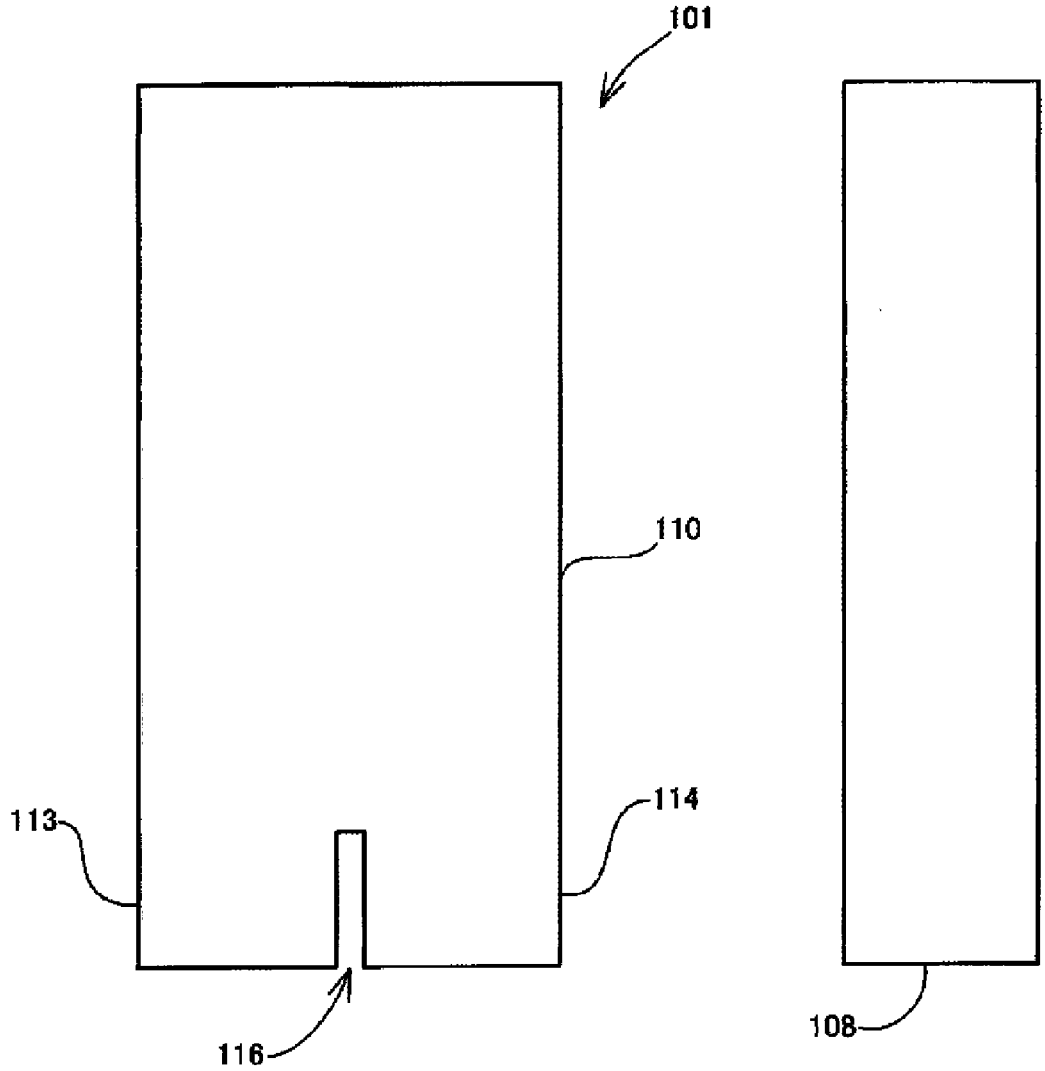
FIG. 10 is three-directional view of the ink tank 101 in accordance with aspects of the invention.
Figure 10:
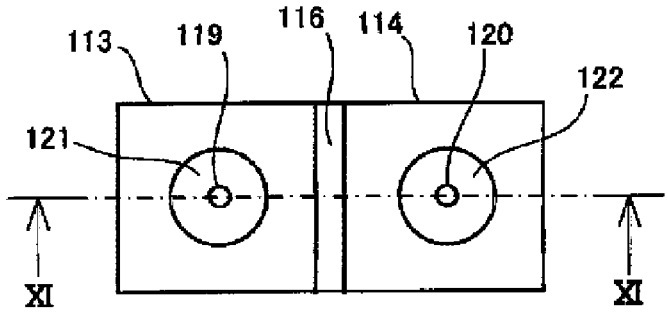
Figure 11:
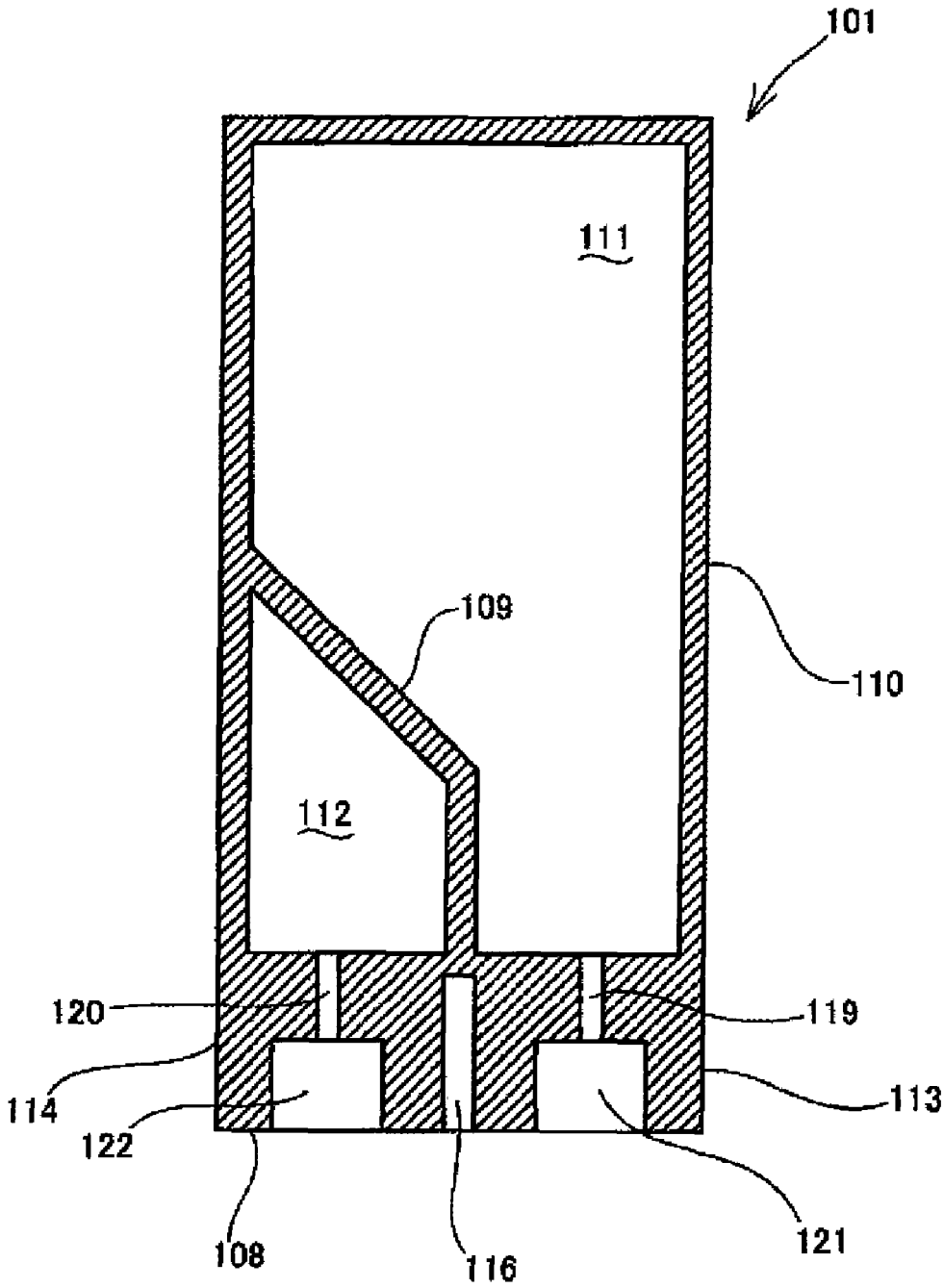
FIG. 11 is a cross-sectional view taken along the line XI-XI in FIG. 10 in accordance with aspects of the invention.

FIGS. 9 to 11 show a configuration of the ink tank 101. FIG. 9 is a perspective view of the ink tank 101 viewed from the bottom side, FIG. 10 is three-directional view of the ink tank 101, and FIG. 11 is a cross-sectional view taken along the line XI-XI in FIG. 10.

As shown in FIG. 11, the ink tank 101 includes an ink chamber 111 in which ink is stored (which corresponds to an ink storage chamber as described herein) and a cleaning solvent chamber 112 in which cleaning solvent is stored (which corresponds to the cleaning solvent storage chamber as described herein). The ink chamber 111 and the cleaning solvent chamber 112 are partitioned by an ink tank casing 110 which defines on outer shell of the ink tank 101 and a partitioning wall 109 for partitioning the ink chamber 111 and the cleaning solvent chamber 112. The partitioning wall 109 is provided at a position which makes the capacity of the ink chamber 111 larger than the capacity of the cleaning solvent chamber 112.

The cleaning solvent is used when sucking and removing ink remaining in the recording head 39 (residual ink) when the ink tank is replaced with a new one. A minimum amount of the cleaning solvent required for sucking and removing operation is stored in the cleaning solvent chamber 112. Although water may be used as the cleaning solvent, ink solvent is used as the cleaning solvent in this embodiment. When the ink solvent which has a high affinity to the residual ink is used as the cleaning solvent, the effect for removing the ink is enhanced. Needless to say, the ink solvent in this case is the same one as the ink solvent used for the ink which is stored in the ink chamber 111. The ink stored in the ink chamber 111 may also be used as the cleaning solvent.

The ink solvent is a solvent for dissolving or disaggregating color materials such as colorant or pigment which determines the color hue of the ink. For example, an aqueous or non-aqueous organic solvent is used. A surface active agent (which is called "dispersing agent") is preferable as the organic solvent. Examples of the aqueous organic solvent include alcohols such as ethanol, n-propanol, polyatomic alcohols such as diethylene glycol or glycerine, and pyrrolidone-based solvent.

The ink tank casing 110 may be molded with a transparent or translucent material such as synthetic resin. Therefore, the liquid stored in the ink chamber 111 and the cleaning solvent chamber 112 can be viewed from the outside. In this embodiment, the entire part of the ink tank casing 110 is molded with the synthetic resin. However, the configuration to make the stored liquid visible from the outside of the ink tank 101 is not limited to this configuration. For example, it is also possible to mold the ink tank casing 110 with opaque synthetic resin, forming a hole at a part of the ink tank casing 110 so as to communicate with the ink chamber 111 and the cleaning solvent chamber 112, and seal the hole with a sheet-type member such as a transparent filter or the like. That is, a configuration in which only a part of the ink tank casing 110 is sight-through is also applicable.

Although both of the ink chamber 111 and the cleaning solvent chamber 112 are sight-through in this embodiment, a configuration in which at least one of the ink chamber 111 and the cleaning solvent chamber 112 is sight-through is acceptable, for example, when the cleaning solvent which is visually identifiable from the ink is stored in the cleaning solvent chamber 112. In this case, if the stored liquid in one of the storage chambers is determined, whether the stored liquid in the other storage chamber is the ink or the cleaning solvent can easily be estimated.

As shown in FIGS. 9 to 11, the ink tank 101 is formed into a substantially parallelepiped shape which is narrow in width and elongated in the vertical direction, and also elongated in the depth direction. The ink tank 101 is provided with mounting portions 113, 114 on the bottom surface side thereof. The mounting portion 113 is provided corresponding to the ink chamber 111 and the mounting portion 114 is provided corresponding to the cleaning solvent chamber 112. The mounting portion 113 corresponds to an ink deriving portion as described herein, and the mounting portion 114 corresponds to a cleaning solvent deriving portion as described herein.

The ink tank 101 is provided with a groove 116 in the middle between the mounting portion 113 and the mounting portion 114 of a bottom surface 108. The groove 116 serves to partition the mounting portion 113 and the mounting portion 114. The mounting portion 113 and the mounting portion 114 are arranged symmetrically with respect to the groove 116, and are formed into the same shape. With the provision of the mounting portions 113, 114 partitioned in this manner, the mounting portion 113 and the mounting portion 114 each assume a shape which protrudes from the bottom surface of the ink tank 101. Mounting of the ink tank 101 to the scanning carriage 38 is achieved by such protruded mounting portions 113, 114 being fitted to the holding unit 40 (see FIG. 12) of the scanning carriage 38, described later.

The mounting portions 113, 114 are formed respectively with cylindrical shaped recesses 121, 122 depressed inwardly from the bottom surface 108 side of the ink tank 101. The recesses 121, 122 are configured to prevent leakage of the storage liquid from the ink chamber 111 and the cleaning solvent chamber 112 with resilient members 135 (see FIG. 12), described later, fitted therein.

The bottom surfaces of the recesses 121, 122 are each formed with a deriving port 119 (which corresponds to an ink deriving port as described herein) and a deriving port 120 (which corresponds to a cleaning solvent deriving port as described herein). The deriving port 119 is configured to derive ink stored in the ink chamber 111 toward the holding unit 40 when the ink tank 101 is fitted to the holding unit 40, and communicates from the outer surface of the ink tank casing 110 to the outside. The deriving port 120 is configured to derive cleaning solvent stored in the cleaning solvent chamber 112 toward the holding unit 40 when the ink tank 101 is fitted to the holding unit 40, and communicates from the outer surface of the ink tank casing 110 to the outside.

Figure 12:
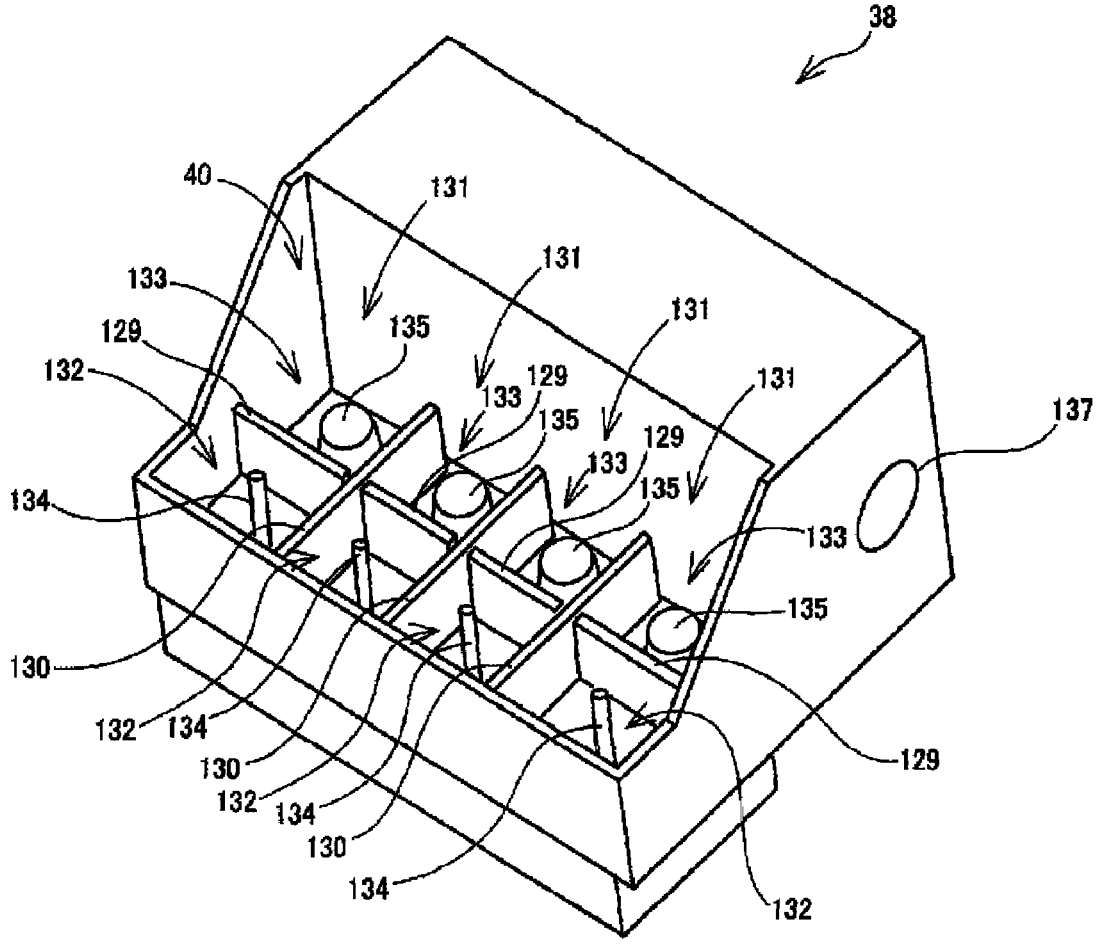
FIG. 12 is a perspective view showing an appearance configuration of a scanning carriage 38 in accordance with aspects of the invention.
Figure 13:
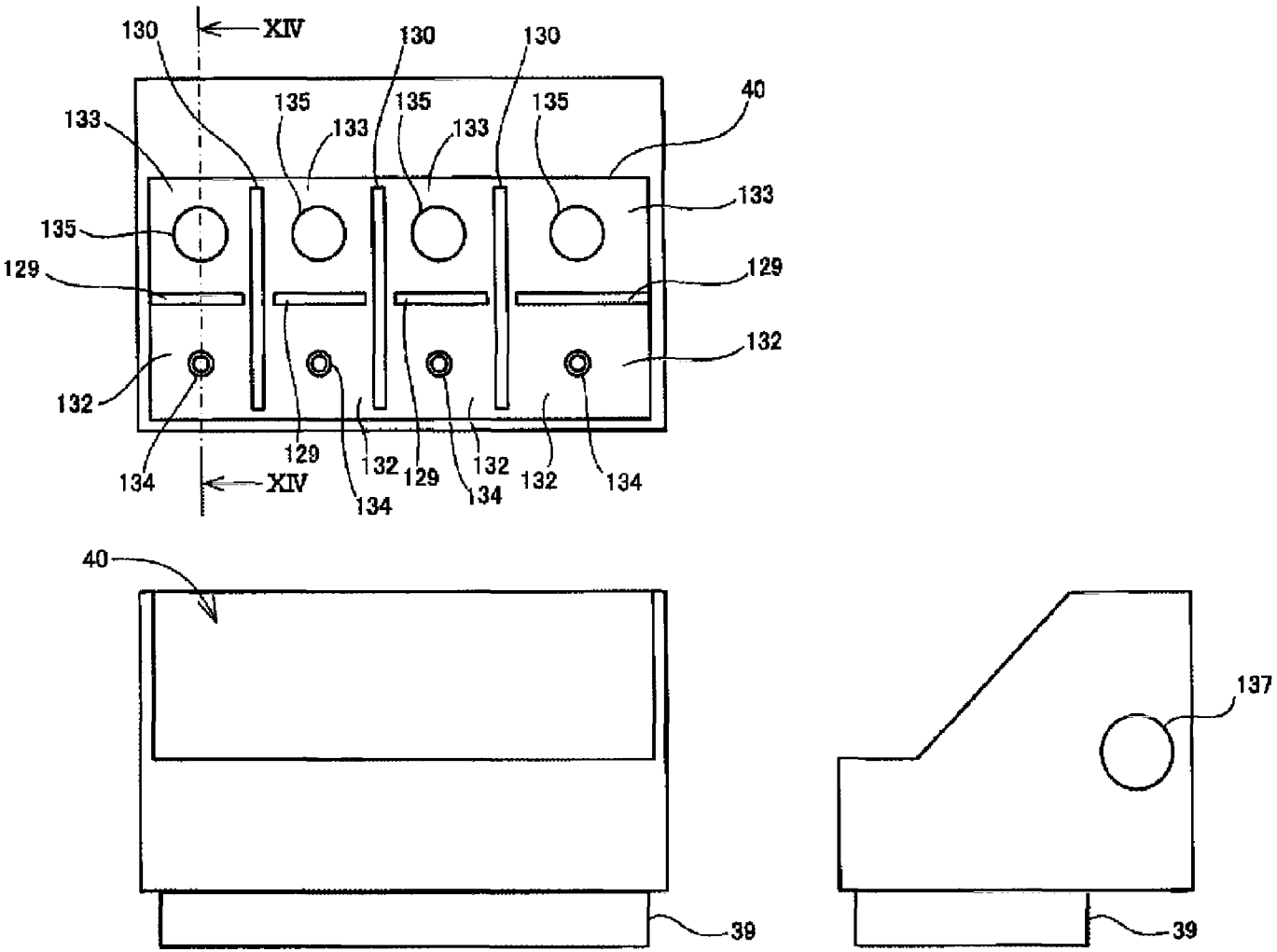
FIG. 13 is a three-directional view of the scanning carriage 38 in accordance with aspects of the invention.
Figure 14:
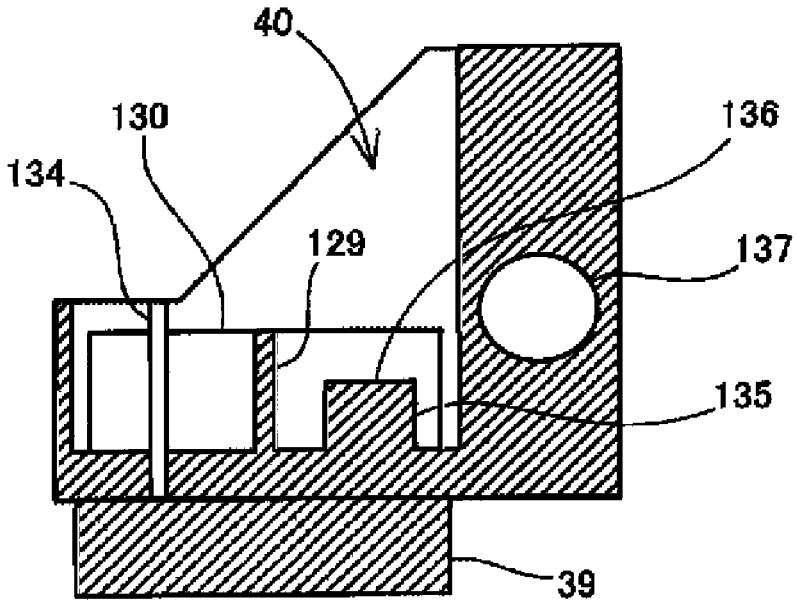
FIG. 14 is a cross-sectional view taken along the line XIV-XIV in FIG. 13 in accordance with aspects of the invention.
Figure 15A:
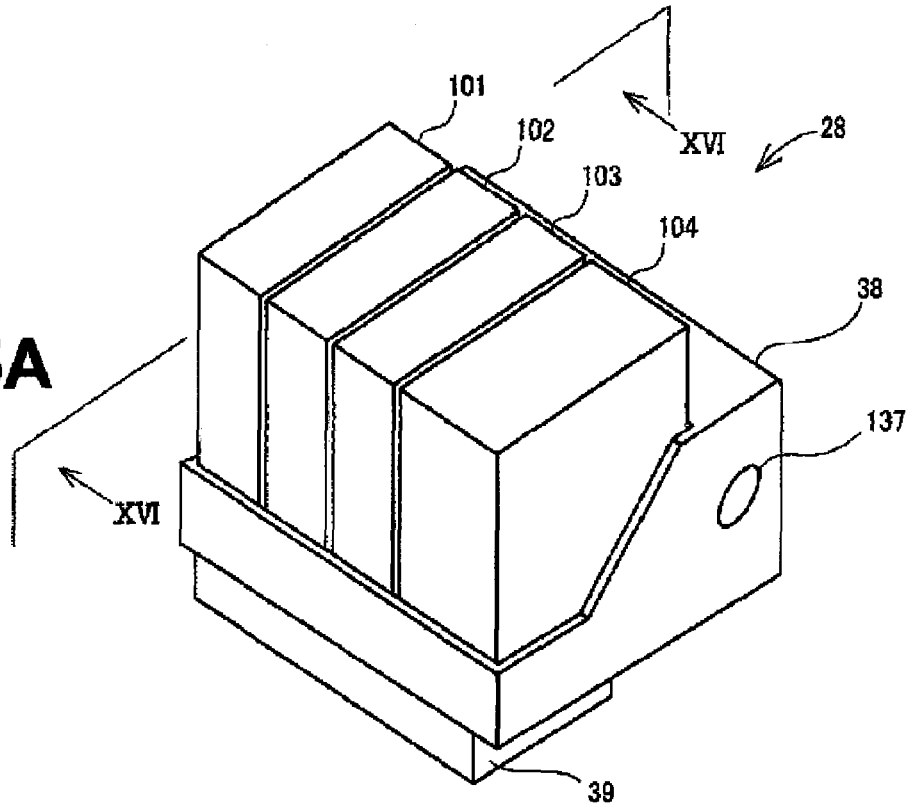
FIG. 15A illustrates an appearance configuration of the head unit 28 and is a perspective view of the head unit 28 in accordance with aspects of the invention.
Figure 15B:
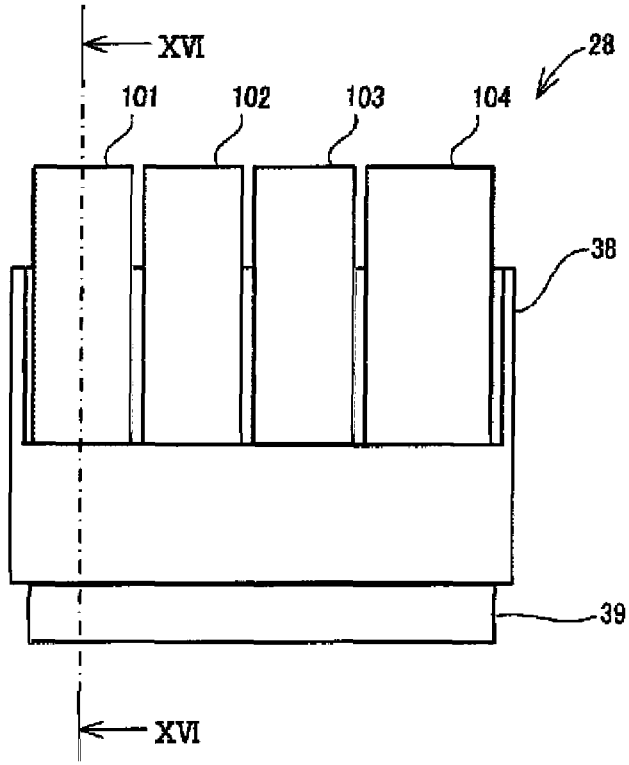
FIG. 15B illustrates an appearance configuration of the head unit 28 and is a front view of the head unit 28 in accordance with aspects of the invention.

FIGS. 12 to 14 are drawings showing a configuration of the scanning carriage 38. FIG. 12 is a perspective view of the scanning carriage 38, FIG. 13 is a three-directional view of the scanning carriage 38, and FIG. 14 is a cross-sectional view taken along the line XIV-XIV in FIG. 13.

As shown in FIGS. 12 to 14, the scanning carriage 38 includes the recording head 39 and the holding unit 40. The holding unit 40 is configured to hold the ink tanks 101 to 104 corresponding to the ink in the respective colors of CMYBk, and is formed integrally with the scanning carriage 38. The holding unit 40 receives supply of ink from the ink tanks 101 to 104 when the four ink tanks 101 to 104 are mounted to the holding unit 40. The supplied ink is supplied to the interior of the recording head 39 through the supply port 59 provided on the recording head 39. Accordingly, discharge of ink drops from the nozzles 53 on the recording head 39 is achieved.

The holding unit 40 is formed into a container shape opened on top, and assumes a parallelepiped shape elongated in the lateral direction. The ink tanks 101 to 104 are arranged in line in the holding unit 40 in the lateral direction. The holding unit 40 is formed with a plurality of partitioning panels 130 extending upright from the bottom surface thereof. The partitioning panels 130 are narrow plate members extending in the direction of the depth of the scanning carriage 38. The partitioning panels 130 partition the four mounting compartments 131, to which the ink tanks 101 to 104 for the respective colors are mounted, in line in the lateral direction. In this embodiment, since the four colors CMYBk of ink are used in the multi-function machine 1, three of the partitioning panels 130 are provided for partitioning the four mounting compartments 131 corresponding to the four ink tanks 101 to 104.

As shown in the drawing, the mounting compartments 131 each include a recessed fitting portion 132 to which one of the mounting portions 113, 114 provided on each of the ink tanks 101 to 104 is fitted, and a block-up member 133 to which the other mounting portion is fitted. The fitting portion 132 and the block-up member 133 are partitioned by a partitioning plate 129 of a narrow plate shape extending upright from the bottom surface of each of the mounting compartment 131. The partitioning plates 129 are provided at positions where the mounting compartments 131 are each divided into halves in the depth direction. The partitioning plates 129 are provided at positions where they are inserted into the grooves 116 formed on the ink tanks 101 to 104 when the mounting portions 113, 114 of the ink tanks 101 to 104 are mounted to mounting compartments 131.

Figure 16B:
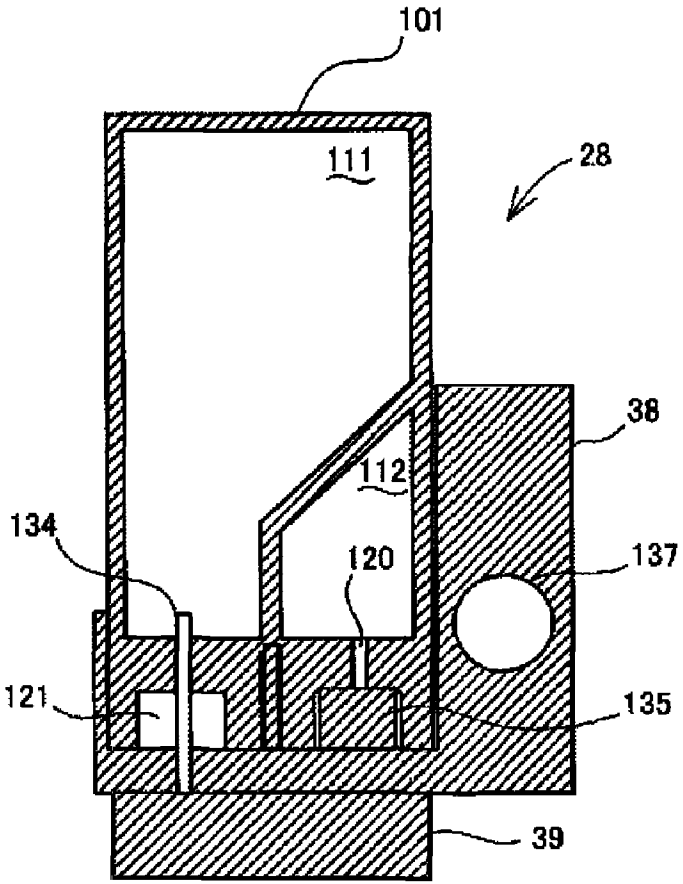
FIGS. 16A and 16B are cross-sectional views taken along the line XVI-XVI in appearance views of the head unit 28 in FIGS. 15A and 15B in accordance with aspects of the invention.
Figure 16A:
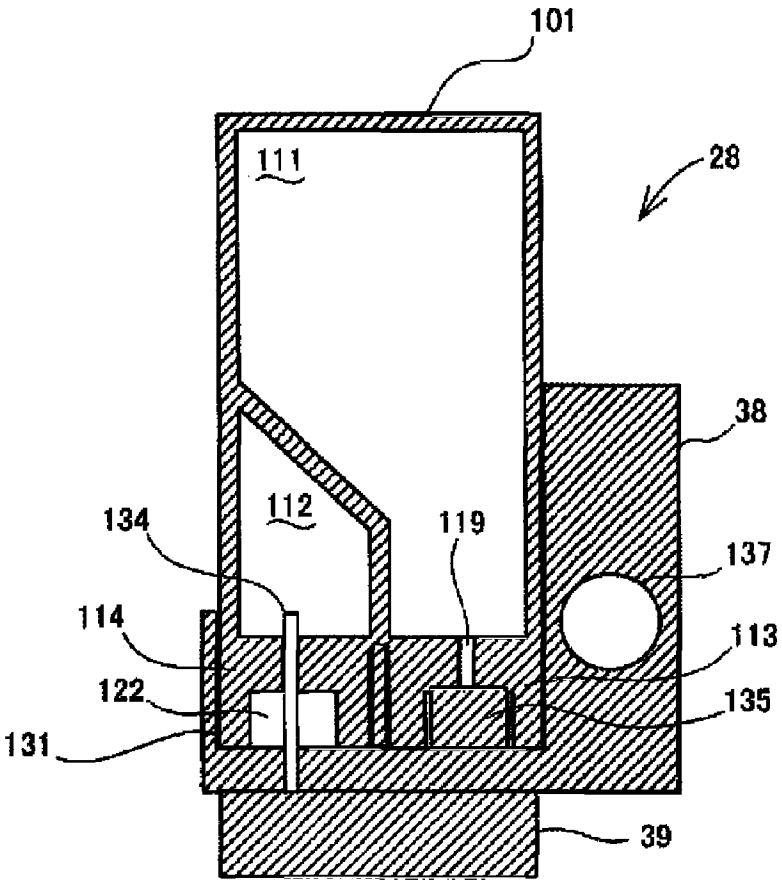

The fitting portions 132 each include a push rod 134 (which corresponds to an introducing member as described herein). The push rod 134 is formed of a metal tube or a resin tube having a minute inner diameter, and assumes the shape like an injection needle. The push rod 134 is provided upright on the bottom surface of the fitting portion 132 is opened at one end at the fitting portion 132 and is connected at the other end to the supply port 59 of the recording head 39. Therefore, for example, as shown in FIG. 16B, when the mounting portion 113 of the ink tank 101 is fitted to the fitting portion 132 by the arbitrary selection of a user, the push rod 134 is inserted to the deriving port 119. At this time, a circulating path of the ink is formed from the ink chamber 111 of the ink tank 101 to the supply port 59 of the recording head 39. Accordingly, a state is achieved in which ink can be introduced into the supply port 59 of the recording head 39 via the push rod 134. As shown in FIG. 16A, when the mounting portion 114 of the ink tank 101 is fitted to the fitting portion 132 by the arbitrary selection of the user, the push rod 134 is inserted into the deriving port 119, so that a circulation path of the cleaning solution is formed from the cleaning solvent chamber 112 of the ink tank 101 to the supply port 59 of the recording head 39. Accordingly, a state is achieved in which the cleaning solution can be introduced into the supply port 59 of the recording head 39 via the push rod 134. FIGS. 16A and 16B are cross-sectional views taken along the line XVI-XVI in appearance views of the head unit 28 in FIGS. 15A and 15B.

Although the push rod 134 is shown as an example of the introducing member in this embodiment, the introducing member as described herein is not limited to the push rod. For example, a structure in which the stored liquid in the ink chamber 111 or the cleaning solvent chamber 112 is introduced to the supply port 59 of the recording head 39 by an ink needle is also applicable. That is, any forms or structures may be employed as long as they are connected to one of the deriving ports 119 and 120 provided on the ink tank 101 so that the stored liquid stored in one of the ink chamber 111 or the cleaning solvent chamber 112 is introduced to the supply port 59 of the recording head 39.

The block-up members 133 each include the column-shaped resilient members 135. The resilient members 135 can be formed integrally with the scanning carriage 38 and extend upright at substantially the centers of the bottom surfaces of the block-up members 133. Each of the resilient members 135 is formed into a shape and a size corresponding to the recesses 121, 122 formed on the bottom surfaces 108 of the ink tanks 101 to 104. Therefore, when the mounting portions 113, 114 of the ink tank 101 are fitted to the mounting compartment 131, the resilient member 135 is inserted into the recess formed on any one of the mounting portions 113, 114 fitted to the block-up member 133. For example, as shown in FIG. 16B, when the mounting portion 113 of the ink tank 101 is fitted to the fitting portion 132, and the mounting portion 114 is fitted to the block-up member 133 by the arbitrary selection of the user, the resilient member 135 is inserted into the recess 122 of the mounting portion 114. At this time, a top portion 136 (see FIG. 14) of the resilient member 135 abuts the bottom surface of the recess 122. Accordingly, the deriving port 120 is blocked (and/or plugged) by the resilient member 135. On the other hand, as shown in FIG. 16A, when the mounting portion 114 of the ink tank 101 is fitted to the fitting portion 132, and the mounting portion 113 is fitted to the block-up member 133 by the arbitrary selection of the user, the resilient member 135 is inserted into the recess 121 of the mounting portion 113. At this time, a top portion 136 (see FIG. 14) of the resilient member 135 abuts the bottom surface of the recess 121. Accordingly, the deriving port 119 is blocked (and/or plugged) by the resilient member 135.

Figure 17:
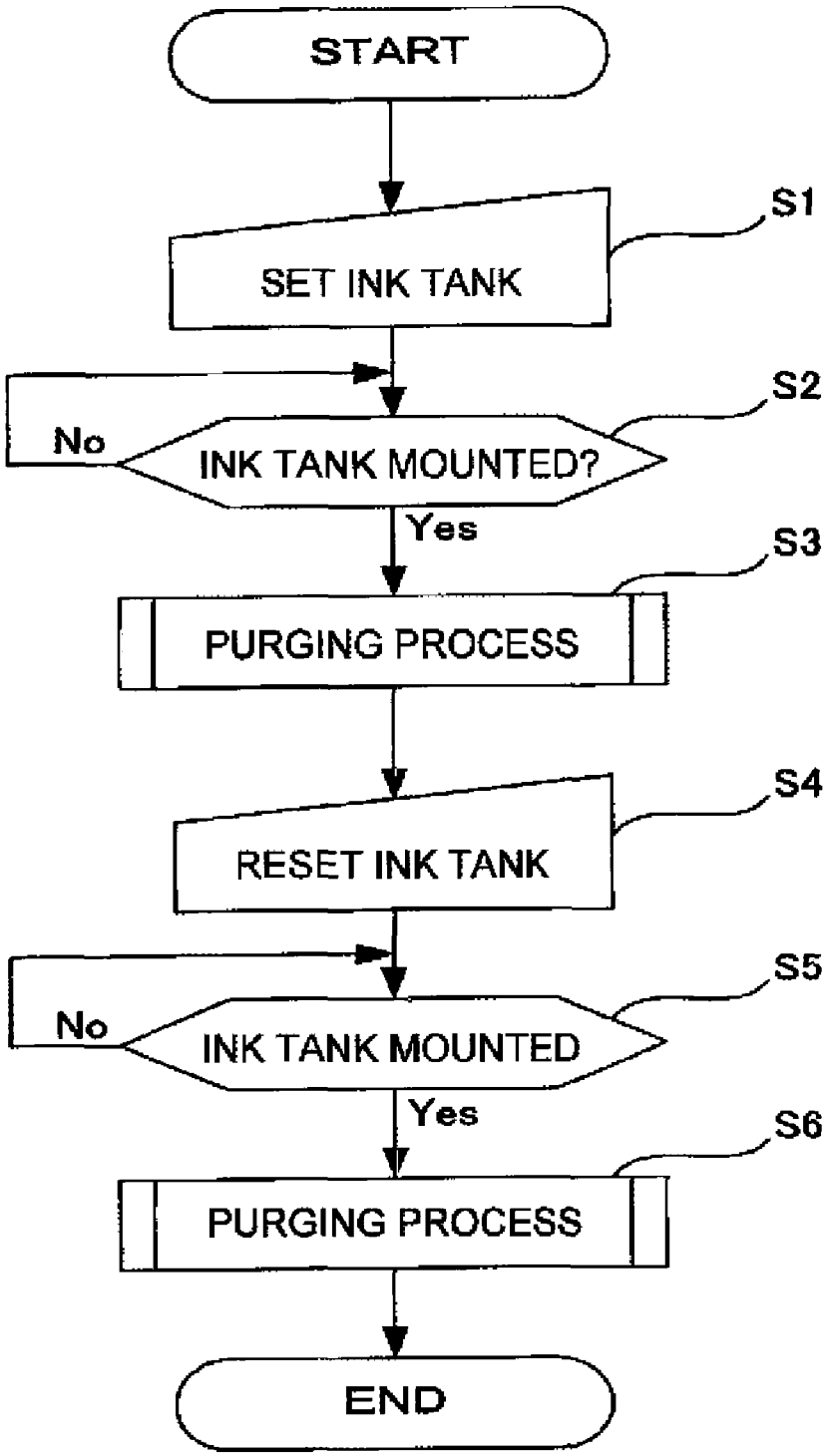
FIG. 17 is a flowchart showing how to mount the ink tank 101 in accordance with aspects of the invention.

FIG. 17 is a flowchart showing how to mount the ink tank 101. Reference signs S1, S2 . . . in the drawing indicate the sequence numbers (step numbers). Referring to the flowchart, how to mount the ink tank 101 and how to supply the cleaning solvent and the ink from the ink tank 101 to the recording head 39 will be described. The replacement of the ink tank and supply of the cleaning solvent and the ink for the ink tanks 102 to 104 other than the ink tank 101 can also be performed in the same sequence described below.

Firstly, the user mounts a new ink tank 101 to the mounting compartment 131 of the holding unit 40 described above (S1). At this time, the ink tank 101 is mounted so that the mounting portion 114 is fitted to the fitting portion 132 and the mounting portion 113 is fitted to the block-up member 133. Accordingly, the push rod 134 is inserted into the deriving port 120 of the mounting portion 114, so that the cleaning solvent in the cleaning solvent chamber 112 can be supplied to the supply port 59 (see FIG. 6) of the recording head 39 via the push rod 134.

In Step S2, whether or not the ink tank 101 was mounted to the mounting compartment 131 is determined (S2). Such determination is achieved easily by providing a contact point for a sensor such as a relay or a switch at a position where a contact terminal comes into contact therewith to conduct electricity when the ink tank 101 is mounted and causing the CPU 65 of the controller 64 to monitor the state of the output signals from the sensor (ON/OFF state).

When the system determines that the ink tank 101 is mounted to the mounting compartment 131, then, the purging operation is carried out (S3) to suck and remove the residual ink remaining in the flow path extending from the push rod 134 to the recording head 39 or in the recording head 39 from the nozzles 53 of the recording head 39. With this purging operation, the residual ink remaining in the recording head 39 or the like is sucked and, simultaneously, the cleaning solvent is sucked out from the cleaning solvent chamber 112 of the ink tank 101 and is supplied to the interior of the recording head 39. Then, by continuing the purging operation, the cleaning solvent supplied to the recording head 39 is sucked and removed from the nozzles 53 while removing ink or foreign substances attached to the buffer tanks 57, the manifolds 56, the cavities 55, and nozzles 53. Accordingly, not only the ink from the ink tank mounted before replacement is removed, but also the flow channel of the ink is cleansed by the cleaning solvent stored in the cleaning solvent chamber 112, which is a separate chamber from the ink chamber 111. Therefore, mixed color ink is not discharged from the recording head 39. Since the residual ink attached on the push rod 134 is not interfused into the ink chamber 111, change of the color of the ink in the ink chamber 111 is prevented.

The printer of the inkjet system is programmed to carry out the predetermined purging operation according to a required process sequence when the ink tank is replaced. It is the same in the multi-function machine 1. The LF motor 71 is controlled by the CPU 64 according to such program, and the purging mechanism 51 is driven to carry out the predetermined purging operation. Since such drive control is known, description will not be made here.

When the purging operation has ended, the ink tank 101 is removed by the user. Then, the ink tank 101 is mounted again to the mounting compartment 131 with the orientation of mounting changed (S4). At this time, the ink tank 101 is mounted so that the mounting portion 113 is fitted to the fitting portion 132, and the mounting portion 114 is fitted to the block-up member 133. Accordingly, the push rod 134 is inserted into the deriving port 120 of the mounting portion 113. Hence a state is achieved in which the ink in the ink chamber 111 can be supplied to the supply port 59 (see FIG. 6) of the recording head 39 via the push rod 134.

Subsequently, in Step S5, whether or not the ink tank 101 is mounted is determined, when the system determines that the ink tank 101 is mounted (Yes in S5), the above-described purging operation is carried out again (S6). With the purging operation in Step S6, the cleaning solvent is purged by the ink, and a state in which the image recording can be started immediately is achieved.

In this manner, through the employment of the ink tank 101 in which the ink is stored in the ink chamber 111 and the cleaning solvent is stored in the cleaning solvent chamber 112, a color mixture of the ink stored in the ink chamber 111 and the residual ink is prevented by mounting the ink tank as described above and causing the predetermined purging operation to be carried out.

In this embodiment, the holding unit 40 is provided in the scanning carriage 38, and the ink tanks 101 to 104 are held in the holding unit 40. However, aspects of the invention may also be applied to the printer unit 2 employing a supply system, in which ink is supplied from an ink tank provided at different place from the scanning carriage 38 to the recording head 39 via an ink tube.

Second Embodiment

Figure 18:
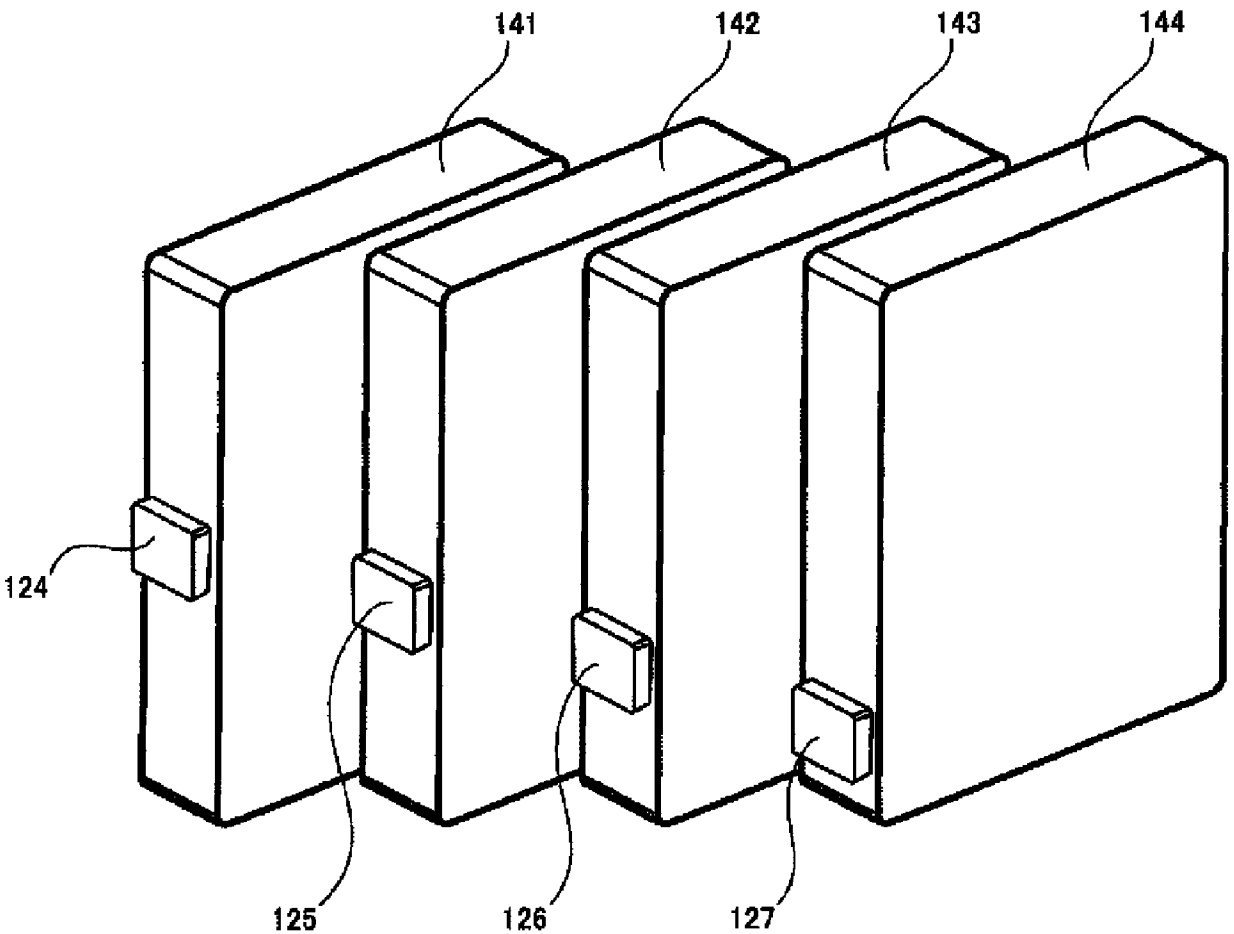
FIG. 18 is a perspective view showing an appearance configuration of the ink tanks 141-144 in the respective colors used in a second embodiment in accordance with aspects of the invention.
Figure 19:
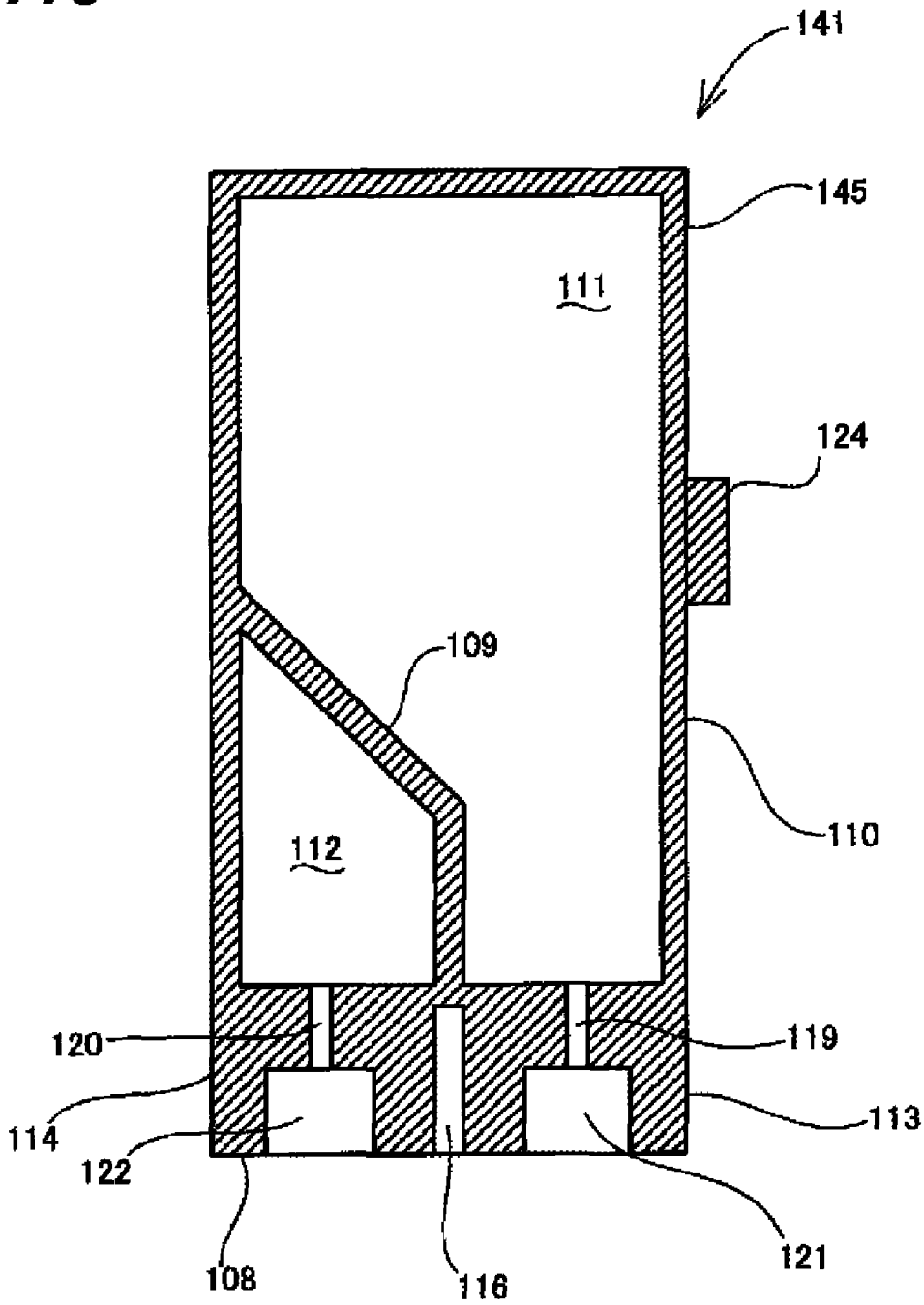
FIG. 19 is a vertical cross-sectional view of the ink tank 141 in accordance with aspects of the invention.
Figure 20A:
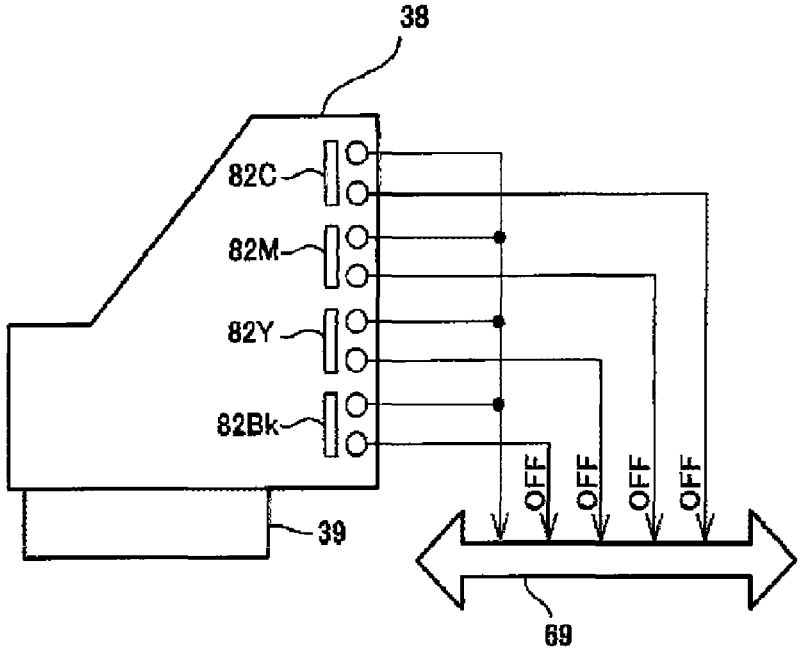
FIGS. 20A and 20B are explanatory sketches showing a method of sensing the ink tank in accordance with aspects of the invention.
Figure 20B:
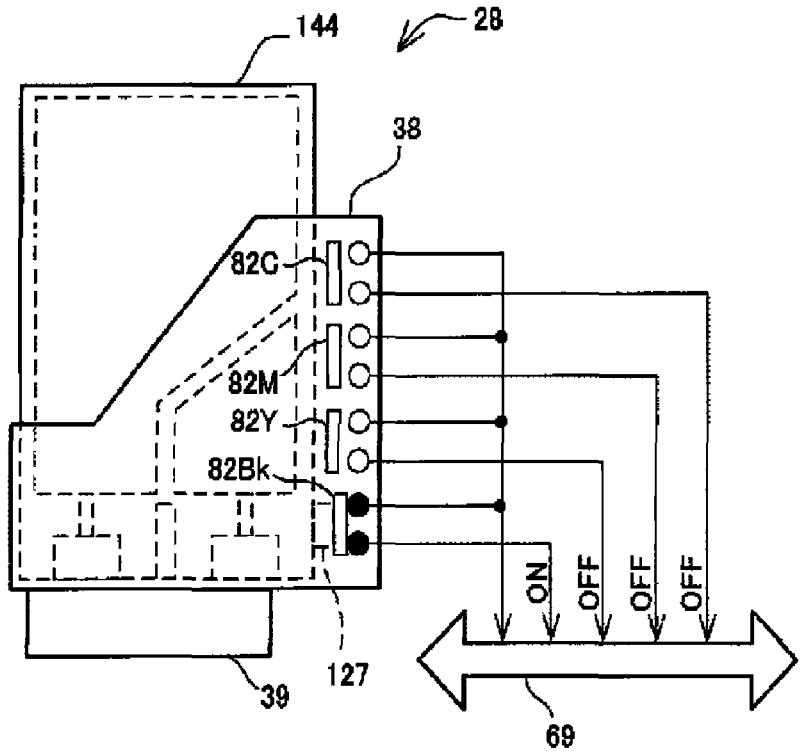
Figure 21:
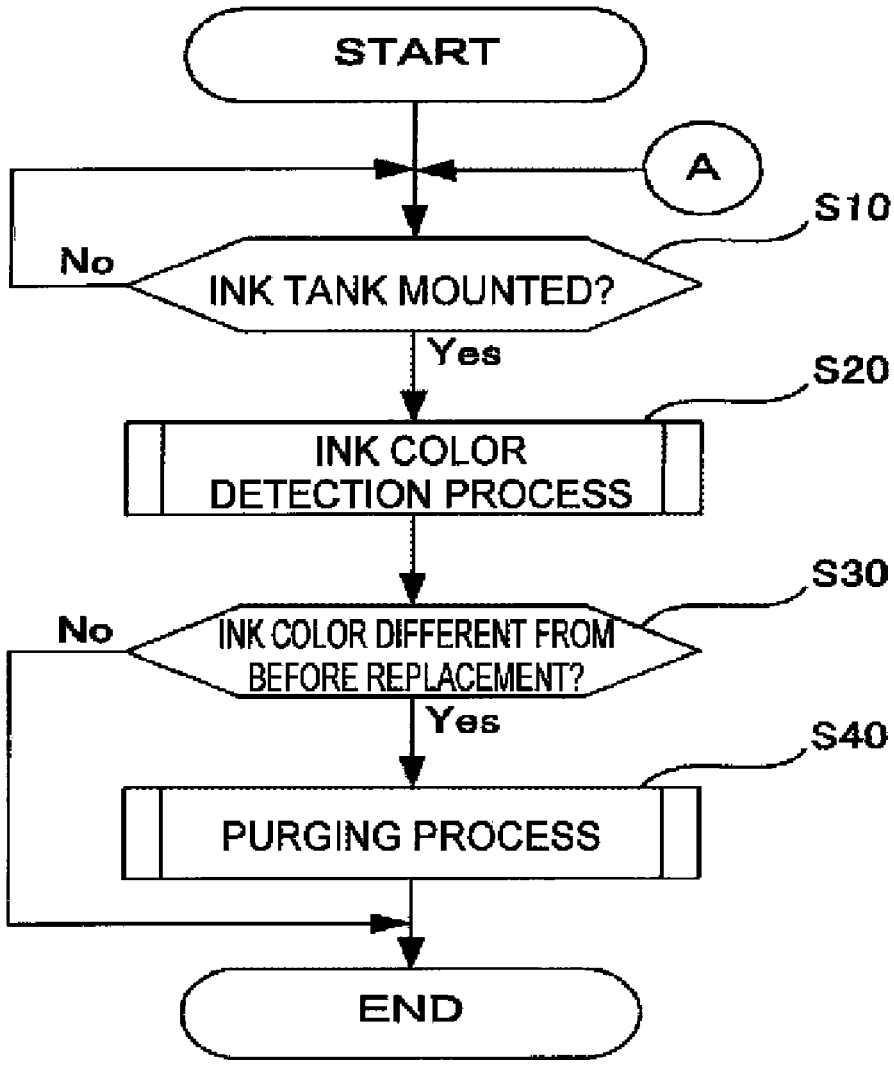
FIG. 21 is a flowchart showing an example of process sequence of the purge control carried out by the CPU 65 in accordance with aspects of the invention.
Figure 22:
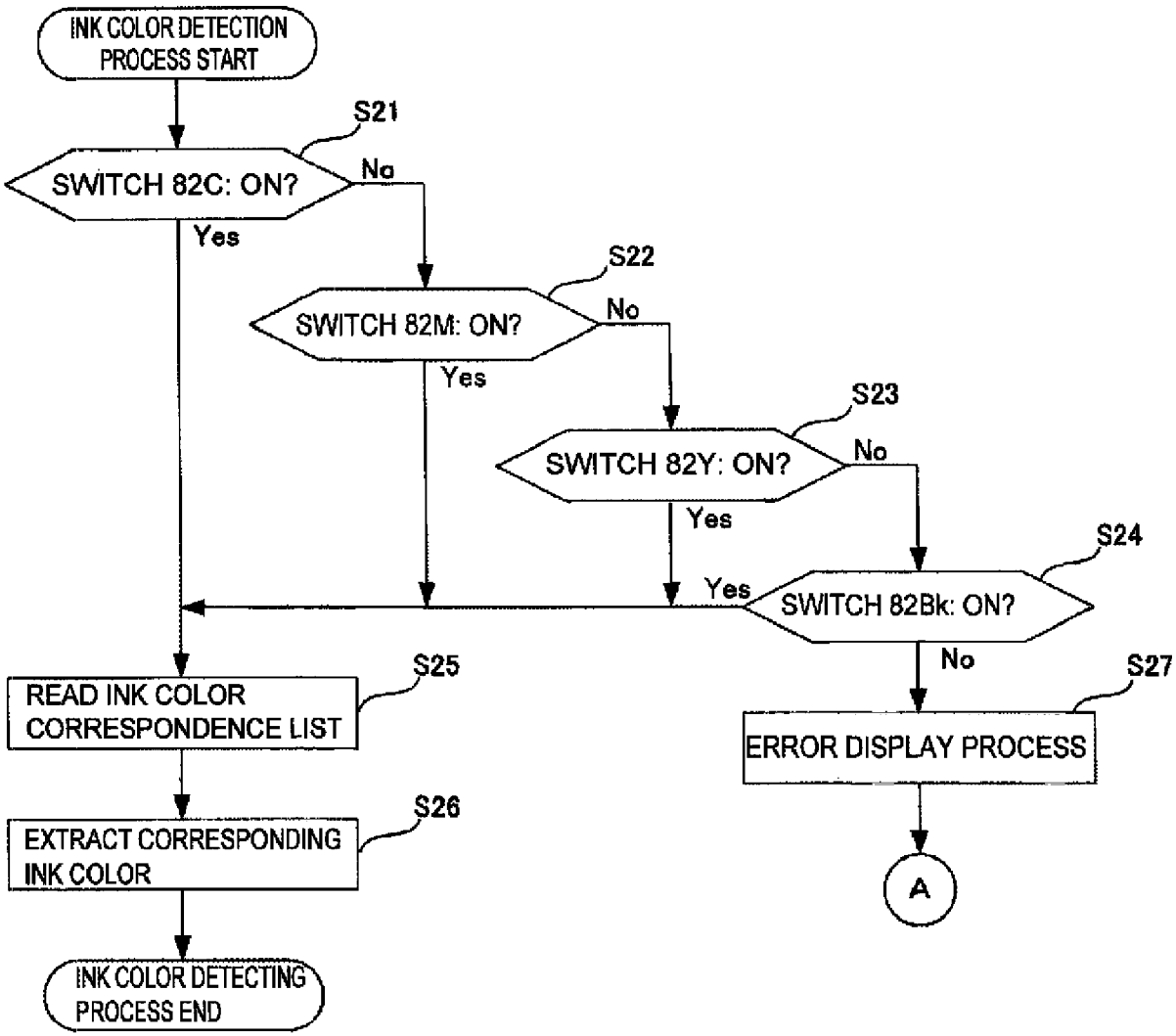
FIG. 22 is a flowchart showing an example of a sequence of an ink color sensing process in accordance with aspects of the invention.

Referring now to FIGS. 18 to 22, a second embodiment of the invention will be described. FIG. 18 is a perspective view showing an appearance configuration of ink tanks 141-144 in the respective colors used in the second embodiment; FIG. 19 is a vertical cross-sectional view of the ink tank 141; FIGS. 20A and 20B are explanatory sketches showing a method of sensing the ink tank; FIG. 21 is a flowchart showing an example of process sequence of the purge control carried out by the CPU 65; FIG. 22 is a flowchart showing an example of a sequence of an ink color sensing process. The components common to the first embodiment are represented by the same reference numerals in the respective drawings and description will not be made again.

As shown in FIG. 18, in this embodiment, the ink tank 141 (in which cyan ink is stored), the ink tank 142 (in which magenta ink is stored), the ink tank 143 (in which yellow ink is stored), and the ink tank 144 (in which black ink is stored) are used, which is different from the first embodiment. The ink tanks 141 to 144 are formed with projections 124 to 127 (which correspond to detected portions as described herein) on respective side surfaces of the ink tanks 141 to 144.

As shown in FIG. 19, the projection 124 is formed integrally with the ink tank casing 110. More specifically, the ink tank casing 110 is provided with the projection 124 on a side surface 145, which defines the ink chamber 111. The projections 124 to 127 are provided on the respective ink tanks 141 to 144 at different positions in height. The respective projections 124 to 127 interact with the switches 82 described later to configure an ink color sensing device as described herein.

As shown in FIG. 20, the above-described switches 82 (an example of the position detecting device as described herein) are assembled on the back surface of the scanning carriage 38. In this embodiment, the switches 82 are provided at positions where the projections 124 to 127 of the respective ink tanks 141 to 144 can press switch contact points when the respective ink tanks 141 to 144 are mounted to the scanning carriage 38. That is, the switches 82 are provided at positions corresponding to the positions on the respective ink tanks 141 to 144 where the projections 124 to 127 are arranged. In this embodiment, there are provided four switches 82C, 82M, 82Y, and 82Bk respectively in the four mounting compartments 131 so as to be capable of sensing the type of the ink tank, that is, which color of ink is stored in the ink tank irrespective of the type of the ink tank and the mounting compartment 131 where the ink tank is mounted. That is, sixteen switches 82 in total are provided on the scanning carriage 38. Lead wires of the respective switches 82 are connected to the bus 69 via the connecting ports. Accordingly, for example, as shown in FIG. 20B, when the black ink tank 144 is mounted to the mounting compartment 131, a switch 82Bk corresponding thereto is pressed, and the switch 82Bk is switched from OFF to ON. Upon sensing this state change of the switch 82Bk, the CPU 65 recognizes that the black ink tank 144 is mounted.

The switches 82 used in this embodiment are mechanical switches having movable portions which are displaced by being pressed by the projections 124 to 127 respectively, and contact points to be electrically conducted by the movable portions coming into contact thereto respectively. It is also possible to employ a relay in stead of such switches 28. Alternatively, a switching device configured with a power semiconductor device such as a transistor as a position detecting device may also be employed.

Referring now to FIGS. 21 and 22, a control process (purge control process) relating the drive of the purging mechanism 51 in the multi-function machine 1 according to the embodiments shown above will be described. The purge control is carried out by the CPU 64 according to the process procedure from Step S10 on in FIG. 21. In the following description, an example of the process procedure when the black ink tank 144 is mounted to the mounting compartment 131 will be described, and since the process procedures to be carried out when the ink tanks 141 to 143 other than black are mounted are the same, these process procedures will not be described here.

Firstly, according to the procedures from Step S21 to Step S24, the state of the respective switches 82 (82C, 82M, 82Y, and 82Bk), that is, whether it is ON or OFF is determined. That is, in Step S21, whether or not the state of the switch 82C is ON is determined. When the system determines that the switch 82C is not ON, but OFF in Step S21, then, whether or not the state of the switch 82M is ON is determined in Step S22. In the Steps S23 and S24, the same determination is performed. Since the black ink tank 144 is mounted in this example, the system determines that the state of the switch 82Bk is ON only in Step S24.

Assuming that the system determines that the state of the switch 82 is not ON, that is, is OFF, in all the Steps S21 to S24, the procedure goes to Step S27. When the state of the switch 820N is not detected even though the ink tank is mounted, the system assumes that the mounting of the ink tank is incomplete, or the orientation of mounting is not correct. Therefore, in Step S27, when the state of the switch 820N is not detected within a predetermined time, an error display process such as displaying this erroneous state on a liquid crystal display of the operation panel 4 is executed.

When the system determines that the state of the switch 82 is ON in any one of Steps S21 to S24, the process in Step S25 is carried out by the CPU 65. That is, an ink color correspondence list (see Table 1) containing information relating the ink colors corresponding to the plurality of switches 82 is read from the ROM 66.

TABLE 1

| SWITCH | INK COLOR |
|---|---|
| SWITCH 82C: ON | CYAN |
| SWITCH 82M: ON | MAGENTA |
| SWITCH 82Y: ON | YELLOW |
| SWITCH 82Bk: ON | BLACK |

When the ink color correspondence list (see Table 1) is read, the ink color corresponding to the switch 82 in ON state is extracted from the ink color correspondence list by the CPU 65 (S26). Therefore, when the switch 82Bk is in the ON state, the ink color correspondence list is referenced, and the system determines that the ink color is black. In this manner, the CPU 65 which reads the ink color correspondence list in Step S25 and extracts the corresponding ink color from the list corresponds to a correspondence information extracting device as described herein. The ink color extracted in this manner is stored in RAM 67 as color information. The color information of the ink color stored in the RAM 67 is accumulatively stored as history every time when the ink tank is replaced. Finally, the series of ink color sensing processes ends.

In this embodiment, the ink color of the mounted ink tank is sensed by the ON/OFF state when the projections 124 to 127 press switches 82. However, a known sensing method, that is, a method of sensing the ink color by causing the ink tank formed of a transparent material to be irradiated with light from a light source such as an LED and receiving reflected light therefrom, and sensing the ink color on the basis of the amount of received reflected light may also be employed. It is also possible to sense the ink color on the basis of the amount of attenuation of transmitted light transmitted through the ink tank, instead of using the reflected light as a matter of course.

When the ink color sensing process (S20) is performed as described above, and the ink color of the mounted ink tank is sensed, subsequently the determination process in Step S30 in FIG. 21 is carried out by the CPU 65. That is, whether or not the sensed ink color is the same as the ink color used before replacement is determined. Such determination is achieved easily by comparing and determining the history of the color information, which is accumulatively stored in the RAM 67, and the ink color sensed in Step S26 (see FIG. 22) as described above.

When the system determines that the sensed ink color is different from the ink color before replacement in Step S30, the purging process like in Step S6 described above is carried out in Step S40. On the other hand, when the system determines that the sensed ink color is the same as the ink color before replacement in Step S30, a series of the purging process ends without carrying out the purging process. It is also possible to carry out the purging process even when the system determines that the sensed ink color is the same as the ink color before replacement. However, the purging process carried out in this case is different from the purging process in Step S6, and the purging process, in which the number of times of purging operations or the purging duration is reduced, is carried out.

By the purge control as described above, the purging process is carried out only when the ink tank of an ink color different from the ink color before replacement is mounted. Accordingly, the time required for purging may be reduced by not carrying out the purging process when the ink color is not changed. Consequently, the time required for achieving a state in which the printing job can be started after replacement of the ink tank may be reduced. Hence user-friendliness is improved.

A modification of the second embodiment will be described. In the second embodiment, the purging process is carried out only when the ink color used before replacement of the ink tank and the ink color after replacement of the ink tank is different. In this modification, a purging process in controlled mode is carried out according to the combination of the ink colors before replacement of the ink tank and after replacement of the ink tank, instead of carrying out the uniform purging process when the ink colors are different as described above.

Figure 23:
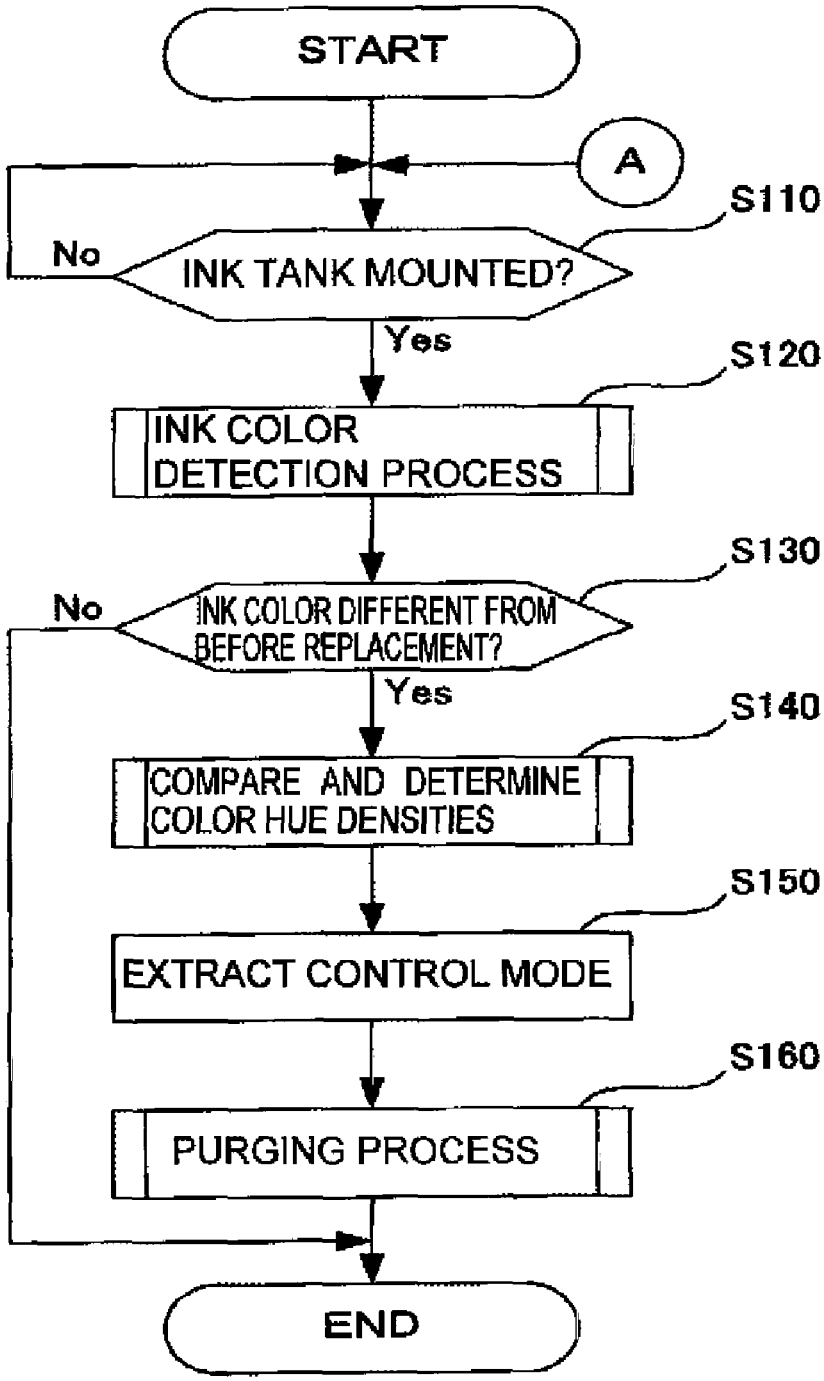
FIG. 23 is a modification of a processing procedure sequence of a purge control carried out by the CPU 65 in accordance with aspects of the invention.

More specifically, as shown in the flowchart in FIG. 23, the same processes as in Steps S10 to S30 (see FIG. 21) are carried out in Steps S110 to S130. FIG. 23 is a modification of the process procedure of the purging control carried out by the CPU 65. When the system determines that the ink color sensed in Step S120 is different from the ink color before replacement in Step S130, then in Step S140, a color hue density comparison determination is carried out by the CPU 65. That is, the ink color before replacement of the ink tank and the ink color after replacement of the ink tank are compared, and whether or not the ink color after replacement has a darker color hue than the ink color before replacement is determined. Such determination is easily achieved by comparing and determining the history of the color information relating the ink color accumulatively stored in the RAM 67 and the ink color sensed in Step S26 (see FIG. 22).

In this embodiment, when the ink color before replacement of the ink tank is a color other than black (cyan, magenta, yellow) and is replaced with the ink tank 144 containing black ink, the system determines to be ink having a darker color hue. In contrast, when the ink color before replacement of the ink tank is black, and is replaced with the ink tanks 141 to 143 having ink other than black (cyan, magenta, yellow), the system determines the ink to be ink having a lighter color hue. Various combinations may be considered as the determination of the density of the color hue according to the type of the ink used or the number of colors of ink. For example, it is also possible to determine the density of the color hue among the color inks. More specifically, when the ink color before replacement of the ink tank is yellow and is replaced with the ink tank having ink such as magenta or cyan, having a darker color hue than yellow, it may be determined to be ink having a darker color hue. When the ink color before replacement of the ink tank is magenta or cyan, and is replaced with the ink tank containing yellow ink, it may be determined to be ink having a lighter color hue.

When the color hue density comparison determination in Step S140 ends, subsequently, a control mode extraction process is carried out by the CPU 65 in Step S150. More specifically, for example, a correspondence list shown in Table 2 is stored in ROM 67 in advance, and a control mode corresponding to the result of determination obtained by the color hue density comparison determination is extracted from the correspondence list. In this embodiment, when the system determines the ink to be a darker color hue, a short-time control mode, which terminates the purging process in time T1, is extracted. In contrast, when the system determines the ink to be a light color hue, a long-time control mode that terminates the purging process in time T2, which is longer than the time T1, is extracted. When the purging process in which suction performed intermittently instead of sucking continuously, the times T1 and T2 are the total time required for the plurality of times of suction.

TABLE 2

| COLOR HUE DENSITY DETERMINATION | CONTROL MODE |
|---|---|
| DARK COLOR HUE | SHORT-TIME MODE (PURGING TIME: T1) |
| LIGHT COLOR HUE | LONG-TIME MODE (PURGING TIME: T2) |

When the extraction process in Step S150 ends, then, in Step S160, the purging process according to the extracted control mode is carried out by the CPU 65. Since the purging process in the control mode according to the result of the color hue density determination is carried out in this manner, the following effects are achieved. That is, even when the link having a light color hue is replaced with the ink having a dark color hue and hence the ink in light color is interfused in the ink in dark color, almost no color change is occurred in the ink. Therefore, in this case, by carrying out the purging process in the short-time mode, which can complete the process in time T1, the time required for the purging process is reduced. In contrast, when the ink of a dark color is used before replacement, and then the ink of a light color is used subsequently, the color change of the ink due to interfusion of ink is remarkable. Hence the purging process for a longer time T2 than the time T1 is carried out. Accordingly, the mixed color ink is at least partially to completely removed.

In this modification, the purging process is carried out in the two types of control modes (short-time mode and the long-time mode) shown in Table 2. However, the purging process may be carried out using three or more control modes depending on the used ink color or the type of the ink as a matter of course.

What is claimed is:

1. A printer comprising:

a refill unit provided on the printer configured to record an image on a recording medium using a plurality of colors of ink; and a plurality of ink tanks demountably mounted to the refill unit, wherein ink is supplied from the ink tanks to a recording head, wherein at least one of the ink tanks includes:

an ink storage chamber configured to store ink;

a cleaning solvent storage chamber configured to store cleaning solvent, the cleaning solvent storage chamber and the ink storage chamber being separated by a partitioning wall;

an ink deriving portion corresponding to the ink storage chamber configured to provide ink from the ink storage chamber to an ink deriving port; and a cleaning solvent deriving portion corresponding to the cleaning solvent storage chamber configured to provide the cleaning solvent from the cleaning solvent storage chamber to a cleaning solvent deriving port, and wherein the refill unit includes:

a holding unit configured to demountably hold each of the plurality of the ink tanks in a first orientation and a second orientation, and an introducing members provided for each of the respective ink tanks, wherein each of the introducing members is configured to connect with the ink deriving portion of the respective ink tank to convey the ink out of the ink storage chamber of the respective ink tank when the respective ink tank is positioned in the first orientation, and wherein each of the introducing members is configured to connect with the cleaning solvent deriving portion of the respective ink tank to convey the cleaning solvent out of the cleaning solvent storage chamber of the respective ink tank when the respective ink tank is positioned in the second orientation.

2. The printer according to claim 1, the holding unit includes a block-up member configured to block one of the ink deriving portion and the cleaning solvent deriving portion while the other one of the ink deriving portion and the cleaning solvent deriving portion is connected to the introducing member.

3. The printer according to claim 2, wherein the block up member includes a member which is configured to engage the ink deriving portion and the cleaning solvent deriving portion in order to block the ink deriving portion and the cleaning solvent deriving portion.

4. The printer according to claim 3, wherein the member is configured to be inserted into the ink deriving portion and the cleaning solvent deriving portion in order to plug the ink deriving portion and the cleaning solvent deriving portion.

5. The printer according to claim 3, wherein the member of the block up member is resiliently biased.

6. The printer according to claim 1, further comprising:

an ink color sensing device configured to sense a color of ink in the ink storage chamber of the ink tank mounted; and a removing device configured to remove residual ink in a recording head based on output from the ink color sensing device.

7. The printer according to claim 6, the ink color sensing device further comprising:

at least one detected portion associated with the ink tank, and arranged at different positions depending on the color type of the ink to be stored in the ink storage chamber, a position sensing device provided in the holding unit configured to detect the position of the detected portions when the ink tank is mounted on the holding unit, a correspondence information storage device configured to store information about ink colors corresponding to the positions of the detected portions, and an extracting device configured to provide an ink color from the correspondence information storage device based on a position of at least one detected portion.

8. The printer according to claim 6, wherein the removing device determines whether or not the ink color sensed by the ink color sensing device is different from the ink color of the ink tank being mounted before replacement, and performs the removing process in a mode according to the determined result.

9. The printer according to claim 8, wherein the removing device performs the removing process only when the ink color sensed by the ink color sensing device is different from the ink color of the ink tank being mounted before replacement.

10. The printer according to claim 8, wherein the removing device performs the removing process in a short-time mode, which is configured to complete the process in time T1 when the ink color sensed by the ink color sensing device is darker than the ink color of the ink tank being mounted before replacement, and performs the removing process in a long-time mode, which is configured to complete the process in time T2, where T2>T1, when the ink color sensed by the ink color sensing device is lighter than the ink color of the ink tank being mounted before replacement.

11. The printer according to claim 1, wherein the ink in the ink storage chamber or the cleaning solvent in the cleaning solvent storage chamber is supplied to the recording head by selectively connecting one of the ink deriving portion and the cleaning solvent deriving portion to the introducing member.

12. The printer according to claim 1, wherein the second orientation is an orientation wherein the ink tank is rotated 180 degrees from the first orientation.

13. The printer according to claim 1, wherein the introducing member is configured to be inserted into the ink deriving port to convey the ink out of the respective ink storage chamber and also configured to be inserted into the cleaning solvent deriving port to convey the cleaning solvent out of the respective ink tank.

14. A printer comprising:

a refill unit provided on the printer configured to record an image on a recording medium using a plurality of colors of ink; and a plurality of ink tanks demountably mounted to the refill unit, wherein ink is supplied from the ink tanks to a recording head, wherein at least one of the ink tanks include:

an ink storage chamber configured to store ink;

a cleaning solvent storage chamber configured to store cleaning solvent, the cleaning solvent storage chamber and the ink storage chamber being separated by a partitioning wall;

an ink deriving portion corresponding to the ink storage chamber configured to provide ink from the ink storage chamber to an ink deriving port; and a cleaning solvent deriving portion corresponding to the cleaning solvent storage chamber configured to provide the cleaning solvent from the cleaning solvent storage chamber to a cleaning solvent deriving port, and wherein the refill unit includes:

a holding unit configured to demountably hold each of the plurality of the ink tanks, and introducing members provided for the respective ink tanks, to which one of the ink deriving portion and the cleaning solvent deriving portion of the ink tank held in the holding unit is selectively connected, the introducing members configured to convey the ink or the cleaning solvent out of the ink tank, wherein the holding unit includes a block-up member configured to block one of the ink deriving portion and the cleaning solvent deriving portion while the other one of the ink deriving portion and the cleaning solvent deriving portion is connected to the introducing member.

15. The printer according to claim 14, further comprising:

an ink color sensing device configured to sense a color of ink in the ink storage chamber of the ink tank mounted; and a removing device configured to remove residual ink in a recording head based on output from the ink color sensing device.

16. The printer according to claim 15, the ink color sensing device further comprising:

at least one detected portion associated with the ink tank, and arranged at different positions depending on the color type of the ink to be stored in the ink storage chamber, a position sensing device provided in the holding unit configured to detect the position of the detected portions when the ink tank is mounted on the holding unit, a correspondence information storage device configured to store information about ink colors corresponding to the positions of the detected portions, and an extracting device configured to provide an ink color from the correspondence information storage device based on a position of at least one detected portion.

17. The printer according to claim 15, wherein the removing device determines whether or not the ink color sensed by the ink color sensing device is different from the ink color of the ink tank being mounted before replacement, and performs the removing process in a mode according to the determined result.

18. The printer according to claim 17, wherein the removing device performs the removing process only when the ink color sensed by the ink color sensing device is different from the ink color of the ink tank being mounted before replacement.

19. The printer according to claim 17, wherein the removing device performs the removing process in a short-time mode, which can complete the process in time T1 when the ink color sensed by the ink color sensing device is darker than the ink color of the ink tank being mounted before replacement, and performs the removing process in a long-time mode, which can complete the process in time T2, where T2>T1, when the ink color sensed by the ink color sensing device is lighter than the ink color of the ink tank being mounted before replacement.

20. The printer according to claim 14, wherein the ink in the ink storage chamber or the cleaning solvent in the cleaning solvent storage chamber is supplied to the recording head by selectively connecting one of the ink deriving portion and the cleaning solvent deriving portion to the introducing member.

21. The printer according to claim 14, wherein the block up member includes a member which is configured to engage the ink deriving portion and the cleaning solvent deriving portion in order to block the ink deriving portion and the cleaning solvent deriving portion.

22. The printer according to claim 21, wherein the member is configured to be inserted into the ink deriving portion and the cleaning solvent deriving portion in order to plug the ink deriving portion and the cleaning solvent deriving portion.

23. The printer according to claim 21, wherein the member is resiliently biased.

24. The printer according to claim 14, wherein the introducing member is configured to be inserted into the ink deriving port to convey the ink out of the respective ink storage chamber and also configured to be inserted into the cleaning solvent deriving port to convey the cleaning solvent out of the respective ink tank.

* * * * *